US011750982B2

(12) United States Patent
Kaiser et al.

(10) Patent No.: US 11,750,982 B2
(45) Date of Patent: Sep. 5, 2023

(54) MICROMECHANICAL SOUND TRANSDUCER

(71) Applicant: Fraunhofer-Gesellschaft zur Foerderung der angewandten Forschung e.V., Munich (DE)

(72) Inventors: Bert Kaiser, Dresden (DE); Lutz Ehrig, Dresden (DE)

(73) Assignee: Fraunhofer-Gesellschaft zur Foerderung der angewandten Forschung e.V., Munich (DE)

( * ) Notice: Subject to any disclaimer, the term of this patent is extended or adjusted under 35 U.S.C. 154(b) by 132 days.

(21) Appl. No.: 17/502,971

(22) Filed: Oct. 15, 2021

(65) Prior Publication Data

US 2022/0046360 A1 Feb. 10, 2022

Related U.S. Application Data

(63) Continuation of application No. PCT/EP2020/060791, filed on Apr. 16, 2020.

(30) Foreign Application Priority Data

Apr. 18, 2019 (DE) ..... 10 2019 205 735.7

(51) Int. Cl.
*H04R 25/00* (2006.01)
*H04R 19/00* (2006.01)
(Continued)

(52) U.S. Cl.
CPC ..... *H04R 19/005* (2013.01); *H04R 1/227* (2013.01); *H04R 17/00* (2013.01); *H04R 31/006* (2013.01); *H04R 2201/003* (2013.01)

(58) Field of Classification Search
CPC .... H04R 2201/003; H04R 5/033; H04R 1/24; H04R 7/06; H04R 19/02; H04R 19/005; H04R 19/00; H04R 3/00
See application file for complete search history.

(56) References Cited

U.S. PATENT DOCUMENTS 5,598,050 A 1/1997 Bowen et al.
9,164,277 B2 10/2015 Conrad et al.
(Continued)

FOREIGN PATENT DOCUMENTS

CN 101284642 A 10/2008
DE 102015206774 A1 10/2016
(Continued)

*Primary Examiner* — Amir H Etesam
(74) *Attorney, Agent, or Firm* — Perkins Coie LLP; Michael A. Glenn

(57) ABSTRACT

Micromechanical sound transducer including a plurality of unilaterally suspended bending transducers. The plurality of bending transducers are configured for deflection within a plane of vibration and are arranged side by side within the plane of vibration along a first axis and are extending along a second axis which is transverse to the first axis. The bending transducers are alternately suspended on opposite sides and engage with one another. Each bending transducer includes a first electrode and a second electrode which are located opposite one another along the first axis to cause deflections of the respective bending transducer along the first axis upon application of voltage. Mutually facing electrodes of adjacent bending transducers are electrically connected to one another by a transverse connection crossing the plane of vibration transverse to the first axis.

15 Claims, 17 Drawing Sheets

(51) Int. Cl.

| | |
|---|---|
| ***H04R 1/22*** | (2006.01) |
| ***H04R 17/00*** | (2006.01) |
| ***H04R 31/00*** | (2006.01) |

(56) References Cited

U.S. PATENT DOCUMENTS

| | | | |
|---|---|---|---|
| 10,483,876 | B2 | 11/2019 | Langa et al. |
| 2008/0239446 | A1 | 10/2008 | Jung et al. |
| 2015/0350792 | A1 | 12/2015 | Grosh et al. |
| 2016/0304333 | A1 | 10/2016 | Gaudet et al. |
| 2016/0362293 | A1 | 12/2016 | Smeys et al. |
| 2018/0179048 | A1 | 6/2018 | Schenk et al. |
| 2018/0202807 | A1 | 7/2018 | Schelling et al. |
| 2020/0087138 | A1* | 3/2020 | Schenk ..... B81B 3/0021 |

FOREIGN PATENT DOCUMENTS

| | | | |
|---|---|---|---|
| DE | 102015210919 | A1 | 12/2016 |
| DE | 102017200108 | A1 | 7/2018 |
| DE | 102017200725 | A1 | 7/2018 |
| DE | 102017206766 | A1 | 10/2018 |
| JP | H1094093 | A | 4/1998 |
| TW | 201902812 | A | 1/2019 |
| WO | 2012095185 | A1 | 7/2012 |
| WO | 2016202790 | A2 | 12/2016 |
| WO | 2020078541 | A1 | 4/2020 |

* cited by examiner section along AA in Fig. 7

MICROMECHANICAL SOUND TRANSDUCER

CROSS-REFERENCES TO RELATED APPLICATIONS

This application is a continuation of copending International Application No. PCT/EP2020/060791, filed Apr. 16, 2020, which is incorporated herein by reference in its entirety, and additionally claims priority from German Application No. DE 10 2019 205 735.7, filed Apr. 18, 2019, which is incorporated herein by reference in its entirety.

Embodiments according to the invention refer to a micromechanical sound transducer.

BACKGROUND OF THE INVENTION

The technical field of the invention described herein may be outlined by the following three documents describing micromechanical components:

WO 2012/095185 A1/Title: MICROMECHANICAL COMPONENT

WO 2016/202790 A2/Title: MEMS TRANSDUCER FOR INTERACTING WITH A VOLUME FLOW OF A FLUID AND METHOD FOR PRODUCING SAME

DE 10 2015 206 774 A1

The three documents mentioned above do not provide any indication of how the packing density of the arrangement may be increased. Basically, these documents disclose the design of bending transducers and the formation of cavities by adjacent bending transducers and their interaction with one other.

Document DE 10 2017 200 725 A1 discloses a layered structure and a method of manufacturing a sensor comprising movable MEMS elements. Below the movable MEMS elements, an electrode device is arranged which detects the movement of the MEMS elements. Furthermore, the cap substrate and the base substrate each have a cavity formed therein which are connected to one another by openings. Both cavities have different pressures, which may be compensated by these openings. An electrically conducting wiring layer, which is connected to the MEMS elements, is applied between the base substrate and the movable MEMS elements by means of known layer deposition methods. Disadvantageously, this wiring layer may be coated with an etch stop layer for further method steps in order not to impair its function.

Document DE 10 2017 200 108 A1 discloses a micromechanical sound transducer arrangement. The sound transducers consist of bending transducers elastically suspended on one side which extend over a cavity and whose edge areas are spaced apart on a front side by a gap. Due to the sound transducers curving, the gap increases. Furthermore, a sound shielding device is disclosed which is formed by the side walls, the so-called sound blocking walls of the cavity. These walls are arranged in such a way that they at least partially prevent lateral sound passage along the gap. What is disclosed as disadvantageous is that the sound transducers are piezoelectric and thus subject to pre-curvature, so that the disclosed measures serve to minimize the inaccuracies resulting from this pre-curvature.

Known solutions do without particularly dense packing, or use external assembly methods to add individual functions (e.g. electrical connection).

In view of this, there is a need for a concept that allows increased packing density compared to the state of the art in order to be able to implement small components and a high sound pressure.

SUMMARY

According to an embodiment, a micromechanical sound transducer may have: a plurality of unilaterally suspended bending transducers, the plurality of bending transducers being configured for deflection within a plane of vibration and being arranged side by side within the plane of vibration along a first axis, the plurality of bending transducers extending along a second axis transverse to the first axis and being alternately suspended on opposite sides and engaging with one another, wherein each bending transducer includes a first electrode and a second electrode located opposite one another along the first axis for guiding deflections of the respective bending transducer along the first axis upon application of voltage, and wherein mutually facing electrodes of adjacent bending transducers are electrically connected to one another by a transverse connection which transversely crosses the plane of vibration to the first axis, so that for first bending transducers suspended on a first side of the opposite sides, the electrodes facing a first direction along the first axis are electrically connected to one another and to the electrodes of second bending transducers which face a second direction opposite to the first direction, which second bending transducers are suspended on a second side of the opposite sides, and for the first bending transducers, the electrodes facing the second direction along the first axis are electrically connected to one another and to the electrodes of the second bending transducers which face the first direction.

The core idea of the present invention is to have recognized that optimal actuator elements may be sensibly accommodated in a MEMS component only if their electrical and fluidic functions are not influenced by the structure itself. This is made possible by a design of the component which will be described below.

In contrast to previous applications, a further core idea is to have recognized that optimal volume utilization may be achieved with optimal actuators also, and especially, by arranging individual actuators within separate air chambers (cavities).

An embodiment concerns a micromechanical sound transducer which has a plurality of bending transducers suspended on one side. The bending transducers may be electrostatic bending actuators (NED actuators) or piezoelectric actuators, for example. The plurality of bending transducers are configured for deflection within a plane of vibration. The bending transducers are arranged side by side within the plane of vibration along a first axis and extend along a second axis which is transverse to the first axis. The bending transducers are alternately suspended on opposite sides and engage with one another. Thus, the bending transducers are fixed on one side and are configured to be freely movable within the plane of vibration at the opposite end.

Each bending transducer has a first electrode and a second electrode, which are located opposite one another along the first axis in order to lead to deflections of the respective bending transducer along the first axis when voltage is applied. For example, if the bending transducer is a piezoelectric actuator, at least two piezoelectric layers of opposite polarity may be disposed between the first electrode and the second electrode. If the bending transducers are electrostatic bending actuators, there may be a thin gap between the first electrode and the second electrode. Due to the thin electrode gap, high forces of electrostatic fields are generated by the applied voltage, and these forces may be transformed to lateral forces by suitable topographies or geometries and lead to curvatures in the bending transducers.

Mutually facing electrodes of adjacent bending transducers are electrically connected to one another by a transverse connection that crosses the plane of vibration transverse to the first axis. In other words, mutually facing electrodes of adjacent bending transducers are electrically connected to one another by a transverse connection that extends along the plane of vibration and is transverse to the first axis. The transverse connection may also be referred to as potential transverse connection and is a current-carrying layer that electrically couples e.g. outer electrodes of adjacent bending transducers to one another. Mutually facing electrodes of adjacent bending transducers are electrically connected to one another by the transverse connection such that for first bending transducers suspended on a first side of the opposite sides, the electrodes facing a first direction along the first axis are electrically connected to one another and to the electrodes of second bending transducers which face a second direction opposite to the first direction, which second bending transducers are suspended on a second side of the opposite sides, and for the first bending transducers, the electrodes facing the second direction along the first axis are electrically connected to one another and to the electrodes of the second bending transducers which face the first direction. According to an embodiment, the first electrodes of the bending transducers may face the first direction along the first axis, and the second electrodes may face the second direction along the first axis. Thus, according to an embodiment, the first electrode of a bending transducer is connected via the transverse connection to a second electrode of a bending transducer adjacent in the first direction and a second electrode of the bending transducer is electrically connected e.g. via a second transverse connection to a first electrode of a bending transducer adjacent in the second direction along the first axis. Due to the transverse connection, e.g. mutually facing outer electrodes of adjacent bending transducers have the same potential.

According to one embodiment, the plurality of bending transducers are arranged within a space bounded in parallel with the plane of vibration by a first and a second substrate, and divide the space along the first direction into cavities arranged between adjacent bending transducers. The tranverse connection is arranged, e.g., between two adjacent bending transducers within a cavity in such a way that this cavity is divided into two sub-cavities. Thus the tranverse connection may serve as a cavity separation between adjacent bending transducers. According to an embodiment, the transverse connection may be lowered in order to fluidically couple the separated sub-cavities to each other. Thus, for example, the transverse connection may have recesses in the direction of the first substrate, along a third axis perpendicular to the plane of vibration, or in the direction of the second substrate, along the third axis, perpendicular to the plane of vibration, whereby adjacent sub-cavities between adjacent bending transducers may be fluidically coupled to one another. This allows adjacent bending transducers to be coupled to one another, resulting in an increased force acting on a fluid within the cavities. Thus, the bending transducers may be arranged with a small distance between them, which leads to advantageous miniaturization. It is also advantageous that adjacent bending transducers are suspended on opposite sides and engage with one another, which allows inertial forces to be compensated for, among other things.

An embodiment provides a micromechanical sound transducer comprising a plurality of suspended bending transducers. The plurality of bending transducers are configured for deflection within a plane of vibration and are arranged side by side within the plane of vibration along a first axis. The plurality of bending transducers extend along a second axis, which is transverse to the first axis. The bending transducers may be optionally suspended on one or both sides. According to one embodiment, the bending transducers are electrostatic or piezoelectric or thermomechanical bending transducers. The bending transducers are deflected by a signal at a signal port such that mutually adjacent bending transducers are deflected in opposite directions along the first axis. This allows the bending transducers to be operated in a push-pull mode, which may compensate for inertial forces of the bending transducers and in this way, for example, basically enables the fluid to be transported into and out of the cavities. Mutually facing sides of the adjacent bending transducers have recesses and projections which are mutually aligned, along the second axis, such that, with opposite deflection of the mutually adjacent bending transducers, projections of a first bending transducer side of the mutually facing bending transducer sides move toward or away from recesses of a second bending transducer side of the mutually facing bending transducer sides, and recesses of the first bending transducer side move toward or away from projections of the second bending transducer side of the mutually facing bending transducer sides. Thus, one achieves that with opposite deflection, adjacent bending transducers exert the same effect on a fluid located within a cavity arranged between the adjacent bending transducers. A further advantage of the recesses and projections is that they allow the packing density of the micromechanical sound transducer to be increased. The depressions and projections may have various shapes, such as rectangular, triangular, quadrangular, or the projections and depressions may have circular segments or elliptical segments. The depressions and projections of the bending transducers may define a contour of the bending transducers. Depending on the shape of the contour of the bending transducer electrodes, for example, the packing density of the micromechanical sound transducer may be increased, and the deflection of the bending transducers and the force acting on the surrounding fluid may be influenced.

A embodiment provides a micromechanical sound transducer comprising a plurality of suspended bending transducers. The plurality of bending transducers are configured for deflection within a plane of vibration and are arranged side by side within the plane of vibration along a first axis. The plurality of bending transducers extend along a second axis which is transverse to the first axis. The bending transducers may be optionally suspended on one or both sides. According to one embodiment, the bending transducers are electrostatic or piezoelectric or thermomechanical bending transducers. The bending transducers are deflected by a signal at a signal port so that adjacent bending transducers are deflected in opposite directions along the first axis. The bending transducers are arranged within a space bounded in parallel with the plane of vibration by a first and a second substrate, and divide the space along a first direction of the first axis into cavities arranged between adjacent bending transducers. Thus, a cavity is bounded, for example, by the first substrate, the second substrate and two opposite sides of adjacent bending transducers. Since the plurality of bending transducers are configured to be deflected within the plane of vibration, the bending transducers may be spaced apart from the first substrate and the second substrate, respectively, such that adjacent cavities may be fluidically coupled to one another By fluidically coupling adjacent cavities, a common force may be exerted by the plurality of bending transducers on a fluid located within the cavities, whereby a high sound level may be implemented with the micromechanical sound transducer. Optionally, the plurality of suspended bending transducers may be suspended on one side. At the free end of the bending transducer, for example, there is a very small distance, which is just about technically feasible, to the surrounding substrate in order not to create an acoustic short circuit. The very small distance is implemented, according to one embodiment, by a substrate facing the free end of the bending transducer being shaped such that the substrate follows a deflection of the bending transducer. For example, the substrate may have a recess in the shape of a segment of a circle or of an ellipse, so that to a deflection of the bending transducer, the distance remains very small due and the movement of the bending transducer is not restricted, for example.

The cavities are alternately widened, along the first direction of the first axis, by first recesses forming first channels in the first and/or in the second substrate and second recesses forming second channels in the first and/or in the second substrate. Since the first and second recesses are located in the first and/or in the second substrate, the cavities are widened e.g. along a third axis which is perpendicular to the plane of vibration. Thus, the volume of the cavities may be increased, while at the same time a high packing density may be implemented. Due to the high packing density and the volume increase of the cavities, miniaturized micromechanical sound transducers with high sound levels may be implemented. According to one embodiment, adjacent cavities have different channels. For example, if one cavity has the first channels, the two adjacent cavities have the second channels. The first and second channels run along the second axis for fluidically coupling the space with the surroundings in opposite directions. This means, for example, that the first channels run in one direction, so that the first channels open to the surroundings at an opening on one side where bending transducers may be suspended, and second channels run in the opposite direction and thus open to the surroundings, for example at an opening on an opposite side where bending transducers may also be suspended. Thus the first and second channels run in parallel with the plurality of bending transducers, for example. Because the first channels and the second channels run in opposite directions, the fluid may flow into the cavities of the micromechanical sound transducer on one side and flow out on the opposite side in an adjacent cavity.

BRIEF DESCRIPTION OF THE DRAWINGS

Embodiments of the present invention will be detailed subsequently referring to the appended drawings, in which.

DETAILED DESCRIPTION OF THE INVENTION

Figure 1:
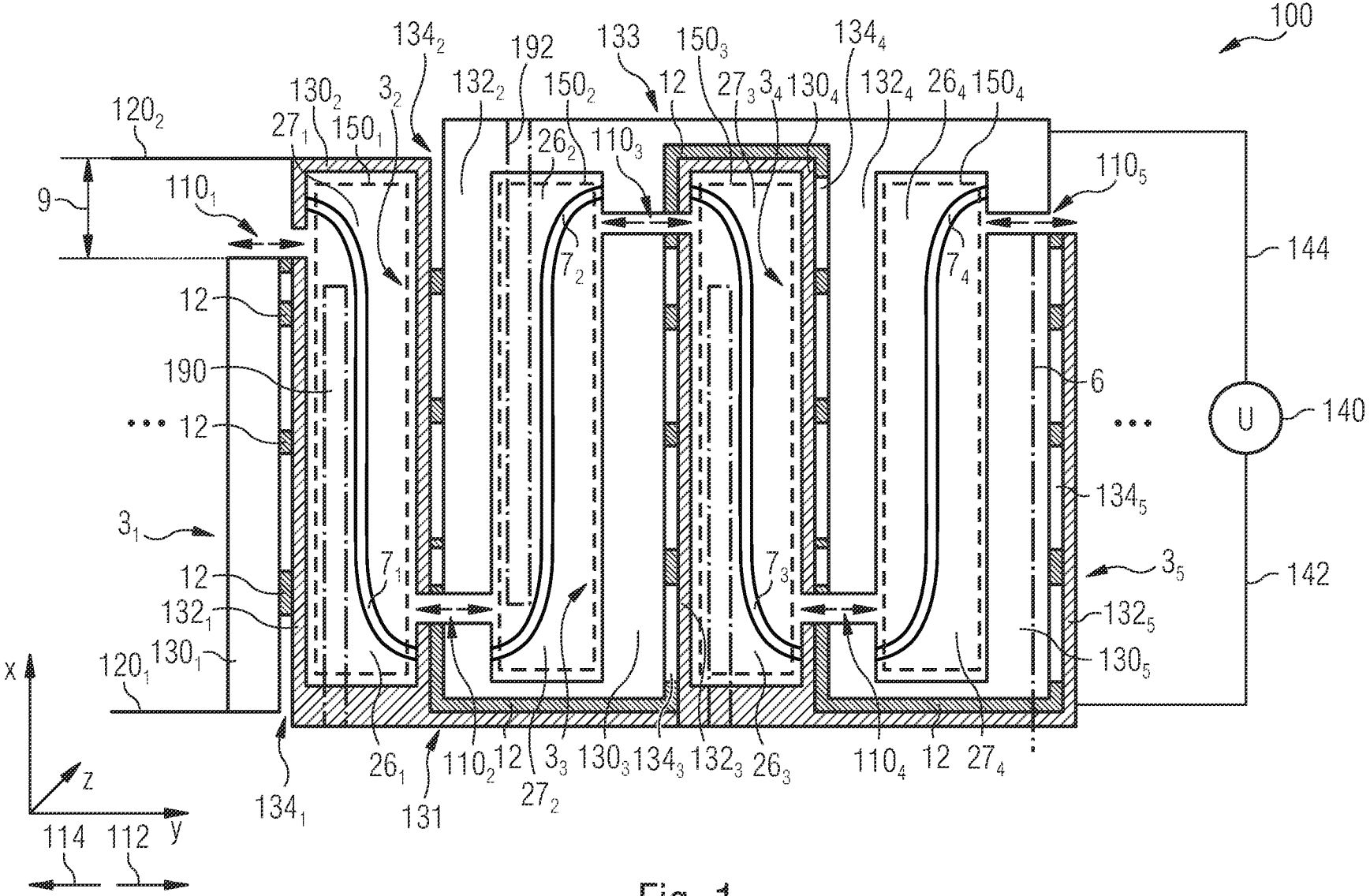
FIG. 1 shows a schematic representation of a micromechanical sound transducer comprising transverse connections according to an embodiment of the present invention.

Before embodiments of the present invention will be explained in detail below on the basis of the drawings, it shall be noted that elements, objects and/or structures which are identical, identical in function or action are provided with identical or similar reference numerals in the different figures, so that the descriptions of these elements shown in different embodiments are interchangeable and/or mutually applicable.

In the following, the bending transducers used comprise, according to one embodiment, a centroid fiber that runs along, or in, a direction of a second axis x. Only in certain embodiments does the centroid fiber run in parallel with the second axis. The centroid fiber represents, for example, an axis of symmetry of the bending transducers or alternatively, for example, a central electrode arranged between a first electrode and a second electrode.

FIG. 1 shows a micromechanical sound transducer 100, comprising a plurality of bending transducers $\mathbf{3}_1$ to $\mathbf{3}_5$ suspended on one side, the plurality of bending transducers 3 are configured for deflection $\mathbf{110}_1$ to $\mathbf{110}_5$ within a plane of vibration (x,y). The bending transducers 3 are arranged side by side along a first axis y. For example, a first bending transducer $\mathbf{3}_1$ is arranged next to a second bending transducer $\mathbf{3}_2$. Optionally, the bending transducers 3 are aligned in parallel with one another. The plurality of bending transducers 3 extend along a second axis x, which is transverse or perpendicular to the first axis y. The bending transducers are alternately suspended on opposite sides and engage with one another. For example, the bending transducers $\mathbf{3}_1$, $\mathbf{3}_3$ and $\mathbf{3}_5$ are fixed on a first side 1201, and the bending transducers $\mathbf{3}_2$ and $\mathbf{3}_4$ are fixed on a second side $\mathbf{120}_2$ opposite the first side 1201. Thus, for example, the bending transducer $\mathbf{3}_2$ is located between the bending transducer $\mathbf{3}_1$ and the bending transducer $\mathbf{3}_3$ and overlaps with the bending transducers $\mathbf{3}_1$ and $\mathbf{3}_3$ at least partially within a projection along the first axis y, whereby the bending transducers engage with one another.

According to an embodiment, within a projection along the first axis y, the bending transducers 3 overlap by more than 15 percent by area, $3_5$ percent by area, 50 percent by area, 65 percent by area, 70 percent by area, 75 percent by area, 80 percent by area, or 85 percent by area between suspension locations of first bending transducers $\mathbf{3}_1$, $\mathbf{3}_3$ and $\mathbf{3}_5$ suspended on the first side 1201 of opposite sides 1201, $\mathbf{120}_2$ and second bending transducers $\mathbf{3}_2$ and $\mathbf{3}_4$ suspended on the second side $\mathbf{120}_2$ of opposite sides 1201, $\mathbf{120}_2$. In other words, when adjacent bending transducers are "superimposed", i.e. one bending transducer is projected onto the adjacent bending transducer (e.g. when a first bending transducer along the first axis y is projected to a position of a second bending transducer), they will overlap by the above specified percentages by area. The first bending transducers $\mathbf{3}_1$, $\mathbf{3}_3$ and $\mathbf{3}_5$ have an offset 9 to the second bending transducers $\mathbf{3}_2$ and $\mathbf{3}_4$.

According to an embodiment, within a projection along the first axis y, the bending transducers 3 overlap by a maximum of 50 percent by area, 60 percent by area, 70 percent by area, or 85 percent by area between suspension locations of the first and second bending transducers.

Figure 2:
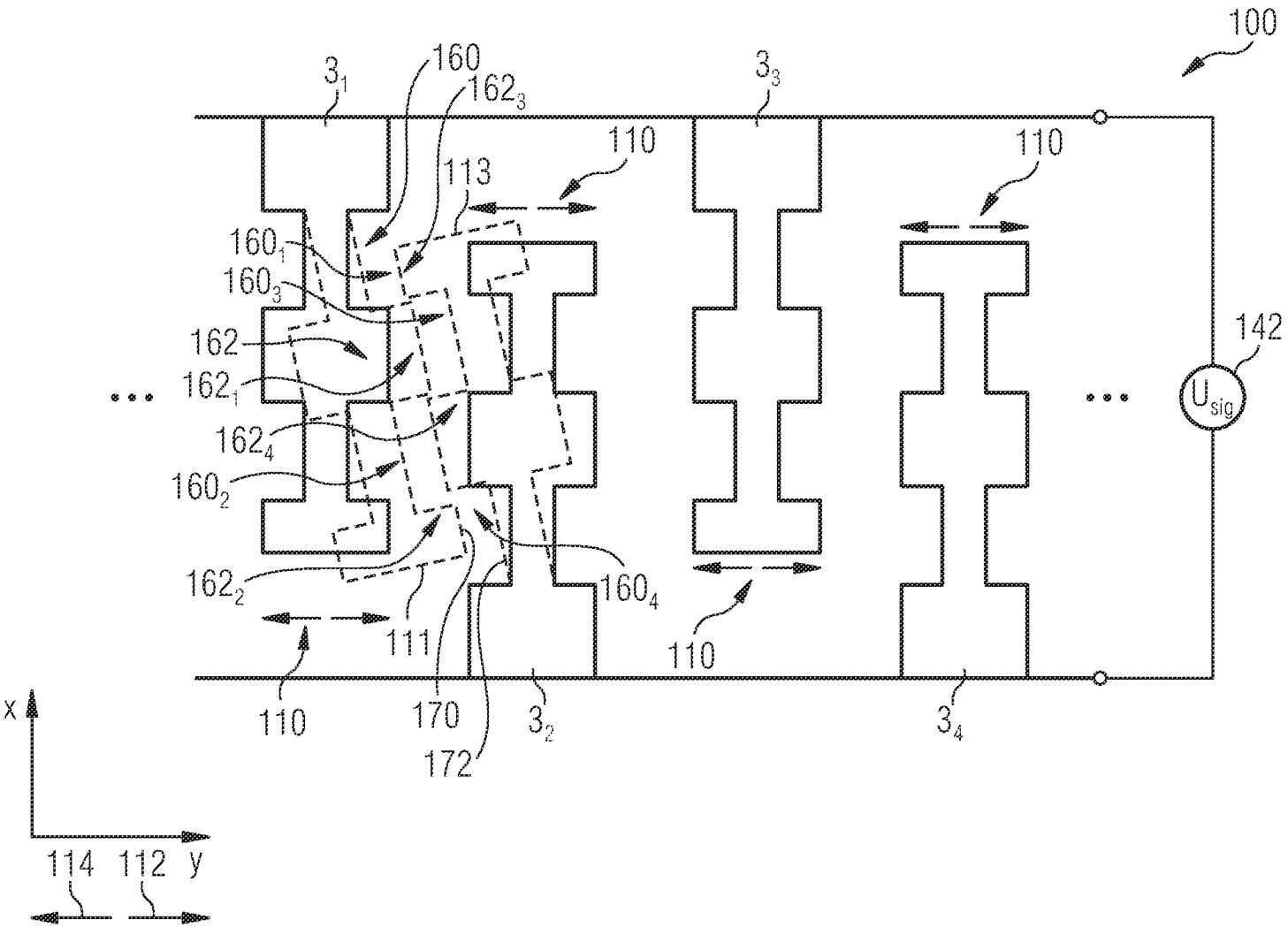
FIG. 2 shows a schematic representation of a micromechanical sound transducer comprising bending transducers having depressions and projections, according to an embodiment of the present invention.
Figure 5:
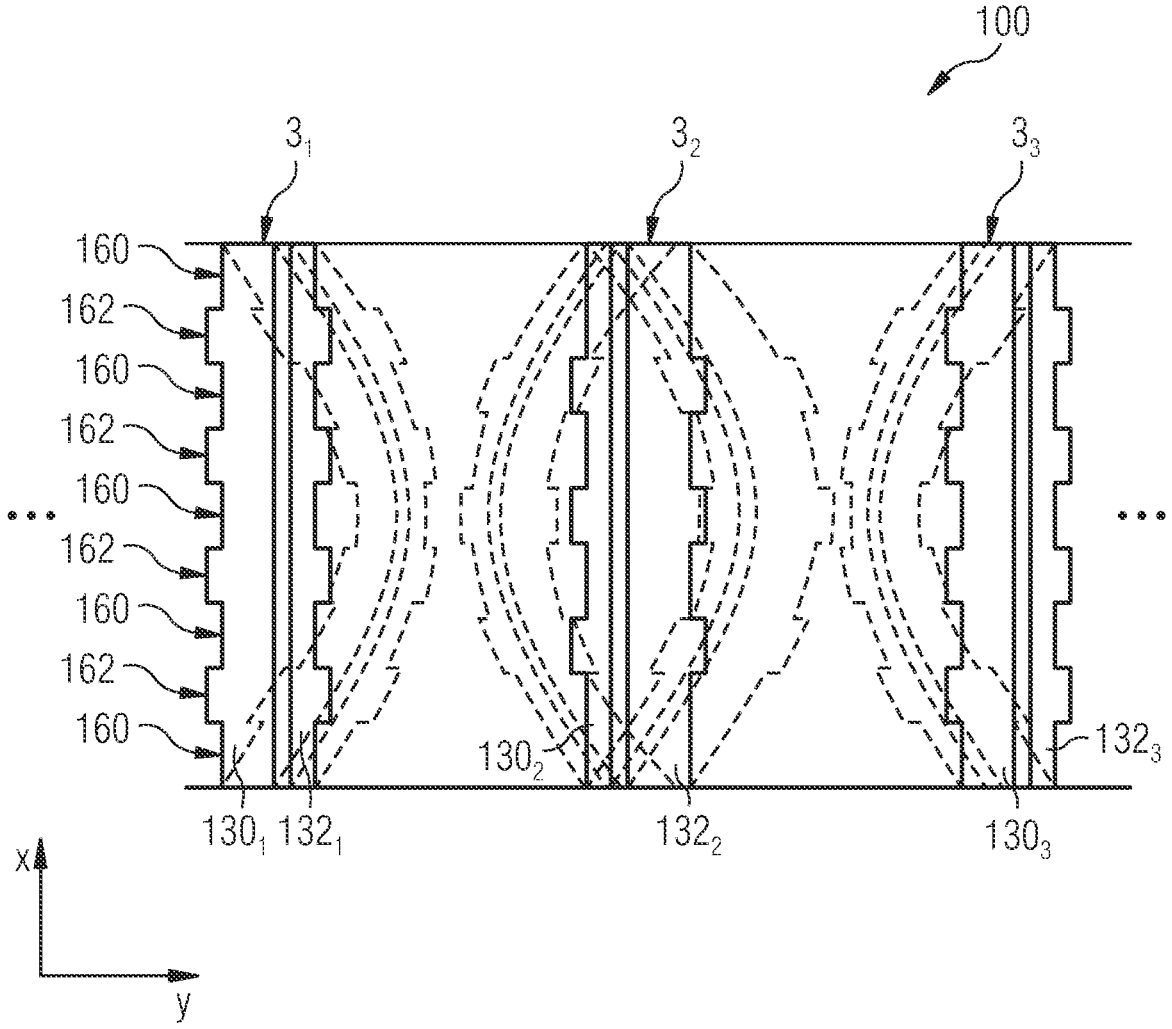
FIG. 5 shows a schematic representation of a micromechanical sound transducer comprising a plurality of bending transducers suspended on both sides, according to an embodiment of the present invention.

According to an embodiment, the bending transducers 3 may have features and functionalities as described with regard to the bending transducers in FIG. 2 or FIG. 5. Optionally, the bending transducers 3 may be designed as shown in FIG. 12*a* to FIG. 14*b*.

In FIG. 1, for example, a section of the micromechanical sound transducer 100 is shown. It is possible, among other things, that further bending transducers are alternately suspended along the first axis y on the opposite sides 1201 and $\mathbf{120}_2$ in a manner in which they engage with one another. This is indicated by the three points, for example.

According to an embodiment, each bending transducer 3 has a first electrode $\mathbf{130}_1$ to $\mathbf{130}_5$ and a second electrode $\mathbf{132}_1$ to $\mathbf{132}_5$, which are located opposite one another along the first axis y. Optionally, between the first electrode $\mathbf{130}_1$ to $\mathbf{130}_5$ and the second electrode $\mathbf{132}_1$ to $\mathbf{132}_5$, there may be at least one gap $\mathbf{134}_1$ to $\mathbf{134}_5$, at least one insulation (or insulating layer) 12 and/or a third electrode, which may also be referred to as central electrode. As shown in FIG. 1, for example, the gap 134 between the first electrodes 130 and the second electrodes 132 may be interrupted by an insulating layer 12 at several points. In other words, the first electrodes 130 are connected to the second electrodes 132 at discrete points in an electrically insulated manner.

According to an embodiment, the bending transducers 3 may have a centroid fiber 6 running along the second axis x or in parallel with the second axis x, which may also be referred to as the axis of symmetry. The bending transducers 3 are symmetrical or asymmetrical with respect to the centroid fiber 6. This means, for example, that a contour of the bending transducers 3 that defines a shape of the bending transducers 3 is symmetrical or asymmetrical. In FIG. 1, the bending transducers 3 are symmetrical in this respect, for example. Optionally, a design of the bending transducer 3 with respect to the centroid fiber 6 may be symmetrical or asymmetrical. In this respect, in FIG. 1 the bending transducers 3 are designed asymmetrically, for example, because the first electrodes 130 and the second electrodes 132 have different extensions along the first axis y and, e.g., the gap 134 is arranged to be offset from the centroid fiber 6 along the first axis y. Alternative shapes and/or structures are shown and described in the context of FIG. 2, FIG. 5 and FIGS. 12*a* to 14*b*.

According to one embodiment, application of voltage 140 results in deflections 110 of the bending transducers 3 along the first axis y. Mutually facing electrodes of adjacent bending transducers are electrically connected by a transverse connection $\mathbf{7}_1$ to $\mathbf{7}_4$. The tranverse connections 7 cross the plane of vibration (x,y) in a manner that is transverse to the first axis y. The tranverse connections 7 are formed such that for first bending transducers $\mathbf{3}_1$, $\mathbf{3}_3$ and $\mathbf{3}_5$ suspended on the first side 1201 of the opposite sides 1201, $\mathbf{120}_2$, the electrodes (according to FIG. 1, e.g. the second electrodes $\mathbf{132}_1$, $\mathbf{132}_3$ and $\mathbf{132}_5$) facing a first direction 112 along the first axis y are connected to one another (e.g. via a connection 131 on the first side 1201) and to the electrodes (e.g. the first electrodes $\mathbf{130}_2$ and $\mathbf{130}_4$), facing a second direction 114 opposite to the first direction 112, of second bending transducers $\mathbf{3}_2$ and $\mathbf{3}_4$ suspended on the second side $\mathbf{120}_2$ of the opposite sides 1201, $\mathbf{120}_2$, and such that for the first bending transducers $\mathbf{3}_1$, $\mathbf{3}_3$ and $\mathbf{3}_5$, the electrodes (according to FIG. 1, e.g. the first electrodes $\mathbf{130}_1$, $\mathbf{130}_3$ and $\mathbf{130}_5$) facing the second direction 114 along the first axis y are electrically connected to one another (according to FIG. 1), e.g. via a connection 133 on the second side $\mathbf{120}_2$) and to the electrodes, facing the first direction 112 (according to FIG. 1, e.g. the second electrodes $\mathbf{132}_2$ and $\mathbf{132}_4$), of the second bending transducers $3_2$ and $3_4$. The tranverse connections 7 may also be referred to as potential tranverse connections. The transverse connections 7 are a current-carrying layer.

According to one embodiment, the micromechanical sound transducer 100 has a signal port 142 and a reference port 144. The electrodes (according to FIG. 1, e.g. the second electrodes $132_1$, $132_3$ and $132_5$), facing the first direction 112 along the first axis y, of the first bending transducers $3_1$, $3_3$ and $3_5$, and the electrodes (according to FIG. 1, e.g. the first electrodes $130_2$ and $130_4$), facing the second direction 114 along the first axis y, of the second bending transducers $3_2$ and $3_4$ are coupled to the signal port 142, for example. The electrodes (according to FIG. 1 e.g. the first electrodes $130_1$, $130_3$ and $130_5$), facing the second direction 114 along the first axis y, of the first bending transducers $3_1$, $3_3$ and $3_5$, and the electrodes (according to FIG. 1, e.g. the second electrodes $132_2$ and $132_4$), facing the first direction 112 along the first axis y, of the second bending transducers $3_2$ and $3_4$ are coupled to the reference port 144, for example.

According to one embodiment, application of the voltage 140 between the signal port 142 and the reference port 144 results in opposite deflections 110 of the first bending transducers $3_1$, $3_3$ and $3_5$ relative to the second bending transducers $3_2$ and $3_4$ along the first axis y. Alternative connections that may be used here are shown and described, for example, with regard to FIG. 10*a*, FIG. 10*b* and in FIGS. 13*a* to 14*b*.

According to one embodiment, the bending transducers 3 are arranged within a space which is bounded, in parallel with the plane of vibration (x,y), by a first and a second substrate and which divide the space along the first direction 112 into cavities $150_1$ to $150_4$ arranged between adjacent bending transducers 3. For example, a first cavity $150_1$ is located between the bending transducers $3_1$ and $3_2$. Each cavity 150, for example, is fluidically coupled to surroundings via one or more openings. The openings are not shown in FIG. 1, but may have features and functionalities as shown and described in connection with FIG. 3, FIG. 4, FIG. 6*b*, FIG. 11*a* and/or FIG. 11*b*.

According to an embodiment, the cavities 150 along the first axis y are each divided by one of the transverse connections 7 into a first sub-cavity $26_1$ to $26_4$ and a second sub-cavity $27_1$ to $27_4$. The transverse connection 7 between the first sub-cavities 26 and the second sub-cavities 27 forms, for example, a fluidic blockage of between 5 and 95 percent by area, between 7 and 93 percent by area or between 8 and 90 percent by area, and limits the deflection 110 of the bending transducers 3 adjacent to the transverse connection 7, thereby preventing the bending transducers from being deflected too much and thus from being damaged or preventing the sound transducer from becoming defective.

According to an embodiment, the transverse connections 7 have an extension (height) along the third axis z. The height of the transverse connections 7 may be used for setting an attenuation of the micromechanical sound transducer. According to an embodiment, a higher transverse connection 7 usually means stronger (fluidic) damping. The height may be structured several times within a section (e.g. the longitudinal extension of a cavity, e.g. along the second axis x) in a direction along a third axis z. In metaphorical terms, for example: lowered $z_1$; lowered $z_2$, lowered etc. (a kind of vertical comb). Reason: not only the summed aperture is exciting but also the individual apertures themselves (sizes of openings seen laterally) at a certain location (e.g. free end of a beam having maximum deflection)

According to an embodiment, each bending transducer 3 may be arranged within a bending transducer cavity, which is formed by a first sub-cavity 26 and a second sub-cavity 27, which are adjacent to the respective bending transducer. The first sub-cavity 26 and second subcavity 27 are demarcated from one another by the bending transducer 3 arranged within the bending transducer cavity. Via connections above and below (i.e. in directions along a third axis z) of the bending transducers 3, the first sub-cavity 26 and second sub-cavity 27 may be connected to each other. According to an embodiment, above defines a first direction along the third axis z, perpendicular to the plane of vibration (x,y) and below defines a second direction along the third axis z, opposite to the first direction, along the third axis. According to FIG. 1, for example, the bending transducer $3_2$ has a bending transducer cavity formed by the first sub-cavity $26_2$ and the second sub-cavity $27_1$.

According to one embodiment, at a free end of the bending transducer 3 there is a very small distance, which is just about technically feasible, to a surrounding substrate in order not to create an acoustic short circuit. The very small distance is implemented, according to one embodiment, in that a substrate facing the free end of the bending transducer is shaped in such a way that the substrate follows a deflection of the bending transducer. This is illustrated, for example, in FIGS. 6*a*, 6*b* and 10*a* to 11*b*.

According to one embodiment, the first sub-cavity $26_1$ to $26_4$ and the second sub-cavity $27_1$ to $27_4$ are fluidically connected. This is implemented, for example, via one or more openings in the first substrate and/or in the second substrate, via a common opening in the first substrate or in the second substrate, or via a lowered transverse connection 7.

Figure 8:
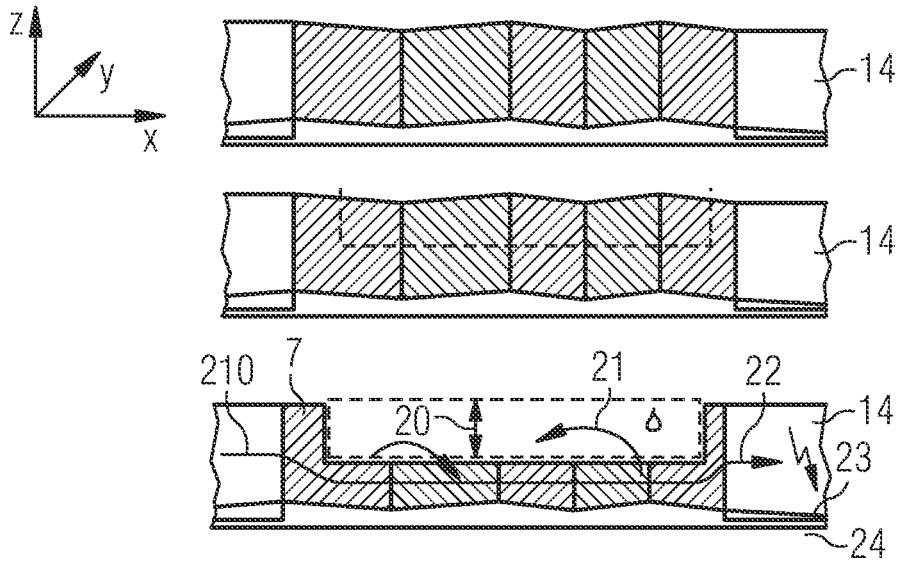
FIG. 8 shows a schematic representation of a method of producing a transverse connection for a micromechanical sound transducer, according to an embodiment of the present invention.

According to an embodiment, the transverse connections 7 are at least partially connected to the first substrate and/or to the second substrate of the micromechanical sound transducer 100. This is illustrated in FIG. 8, for example.

According to one embodiment, the transverse connections 7 follow a contour of the bending transducer 3 at maximum deflection.

According to an embodiment, a first extension of the transverse connections 7 corresponds, at a maximum, to an extension of the bending transducer 3 along the third axis z, perpendicular to the plane of vibration. The first extension of the tranverse connections 7 varies, e.g., along the second axis x.

FIG. 2 shows a schematic representation of a micromechanical sound transducer 100 comprising a plurality of suspended bending transducers $3_1$ to $3_4$, according to an embodiment of the present invention. The plurality of bending transducers 3 are configured to deflect 110 within a plane of vibration (x,y) and are arranged side by side within the plane of vibration (x,y) along a first axis y. The bending transducers 3 extend along a second axis x which is transverse to the first axis y. According to an embodiment, the micromechanical sound transducer 100 of FIG. 2 may have features and functionalities of the micromechanical sound transducer 100 of FIG. 1, even if they are not drawn in FIG. 2.

The bending transducers 3 are deflected by a signal at a signal port 142 in such a way that mutually adjacent bending transducers 3 are deflected in opposite directions along the first axis y. For example, a first bending transducer $3_1$ is deflected in a first direction 112 along the first axis y, and a second bending transducer $3_2$ is deflected in a second direction 114 along the first axis y. This deflection is shown in dashed lines 111, 113 in FIG. 2. Mutually facing sides of the mutually adjacent bending transducers have depressions 160 and projections 162 which are mutually aligned along the second axis x such that, with opposite deflections 110 of the mutually adjacent bending transducers 3, projections 162 of a first bending transducer side of the mutually facing bending transducer sides move toward or away from depressions 160 of a second bending transducer side of the mutually facing bending transducer sides, and depressions 160 of the first bending transducer side move toward or away from projections 162 of the second bending transducer side of the mutually facing bending transducer sides.

In FIG. 2, a movement of two mutually facing bending transducer sides toward each other is shown in dashed lines by reference numerals 111 and 113. For example, the first bending transducer $\mathbf{3}_1$ of the adjacent bending transducers $\mathbf{3}_1$ and $\mathbf{3}_2$ has a first bending transducer side 170 facing the first direction 112, and the second bending transducer $\mathbf{3}_2$ has a second bending transducer side 172 facing the second direction 114. The first bending transducer side 170 is thus arranged facing the second bending transducer side 172. For example, the first bending transducer side 170 has two depressions $\mathbf{160}_1$ and $\mathbf{160}_2$ and two projections $\mathbf{162}_1$ and $\mathbf{162}_2$, and the second bending transducer side 172 also has two depressions $\mathbf{160}_3$ and $\mathbf{160}_4$ and two projections $\mathbf{162}_3$ and $\mathbf{162}_4$. When the bending transducers $\mathbf{3}_1$ and $\mathbf{3}_2$ move toward each other, as shown in 111 and 113, for example, the projections $\mathbf{162}_3$, $\mathbf{162}_4$ of the second bending transducer side 172 move toward the depressions $\mathbf{160}_1$ and $\mathbf{160}_2$ of the first bending transducer side 170, and the depressions $\mathbf{160}_3$ and $\mathbf{160}_4$ of the second bending transducer side 172 move toward the projections $\mathbf{162}_1$ and $\mathbf{162}_2$ of the first bending transducer side 170.

According to an embodiment, the bending transducers 3 may be suspended on one side, as shown in FIG. 2, or on both sides, as shown in FIG. 5. FIG. 5 also shows, like FIG. 2, possible deflections of bending transducers 3 having projections 162 and depressions 160. The micromechanical sound transducer 100 shown in FIG. 5 may have features and functionalities as described in FIG. 2 for the micromechanical sound transducer 100 shown there. In FIG. 2, the bending transducers 3 are depicted schematically only. The bending transducers may be electrostatic (as described in FIG. 1), piezoelectric or thermomechanical bending transducers. In contrast, the bending transducers 3 in FIG. 5 have first electrodes 130 and second electrodes 132. Accordingly, the bending transducers 3 in FIG. 5 may be electrostatic or piezoelectric bending transducers as also described in FIG. 1; a gap, an insulating layer, further electrodes or at least a piezoelectric layer being arranged between the first electrodes 130 and the second electrodes 132. Thus, FIG. 5 represents an embodiment of a micromechanical sound transducer 100 that is an alternative to the embodiments in FIG. 1 and FIG. 2 and may have the features and functionalities described with regard thereto. Optionally, the micromechanical sound transducers 100 of FIG. 1, FIG. 2 and FIG. 5 may also have features and functionalities of the micromechanical sound transducer described in FIG. 3 and/or FIG. 4.

Figure 3:
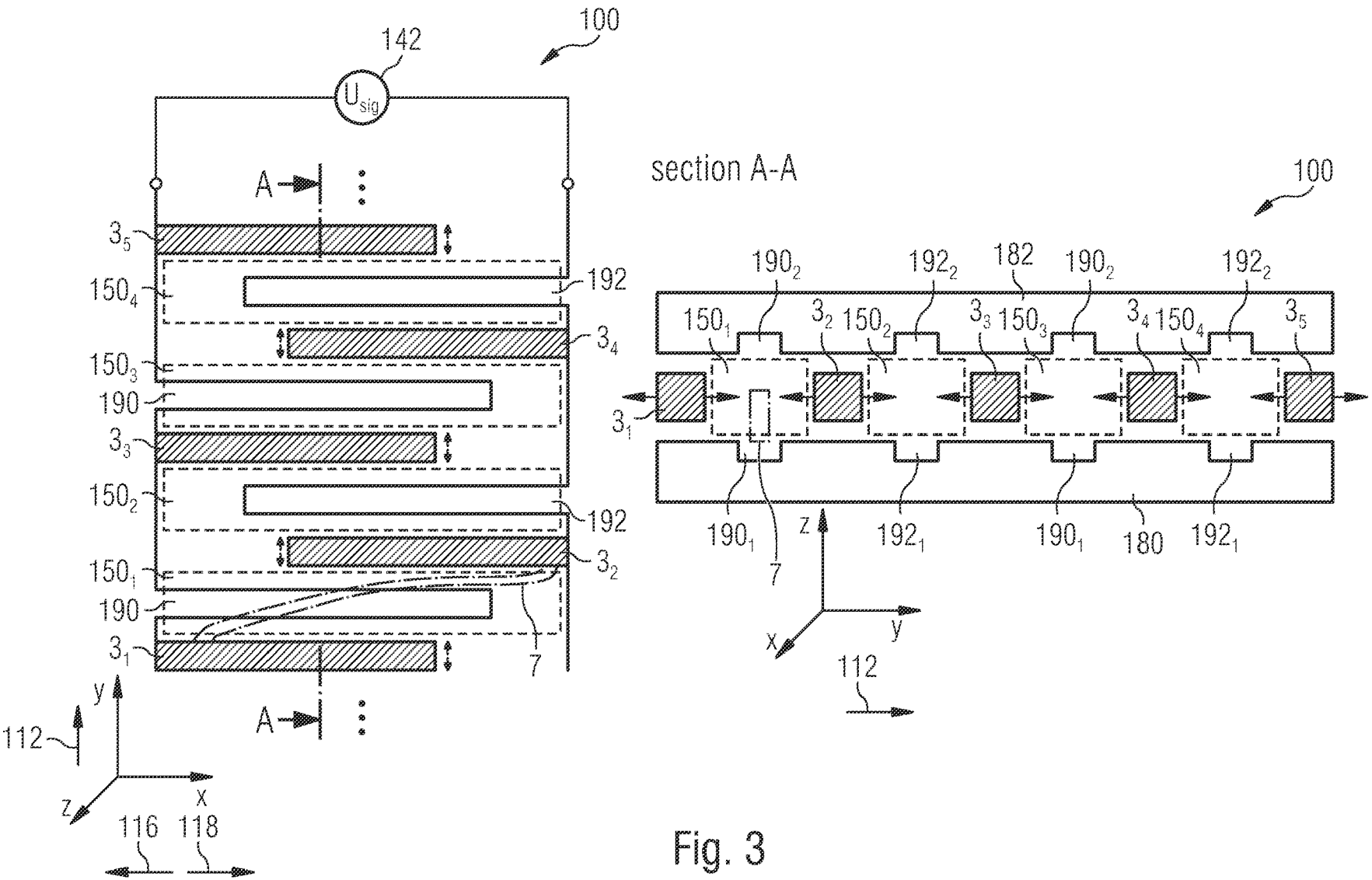
FIG. 3 shows a schematic representation of a micromechanical sound transducer according to an embodiment of the present invention, wherein cavities are expanded by first and second channels.

FIG. 3 shows a micromechanical sound transducer 100 comprising a plurality of suspended bending transducers $\mathbf{3}_1$ to $\mathbf{3}_5$, according to an embodiment of the present invention, on the left as a plan view, and on the right as a cross-section along the cut edge A-A in the plan view. The plurality of bending transducers 3 are configured for implementation within a plane of vibration (x,y) and are arranged side by side within the plane of vibration (x,y) along a first axis y. The plurality of bending transducers 3 extend along a second axis x, which is transverse to the first axis y. The bending transducers 3 are deflected by a signal at a signal port 142 such that mutually adjacent bending transducers are deflected in opposite directions along the first axis y.

The bending transducers 3 are arranged within a space which is bounded in parallel with the plane of vibration by a first 180 and a second 182 substrate, and divide the space along a first direction 112 of the first axis y into cavities $\mathbf{150}_1$ to $\mathbf{150}_4$ which are arranged between adjacent level converters 3.

The cavities 150 are alternately expanded, along the first direction 112, by first recesses forming first channels 190, $\mathbf{190}_1$, $\mathbf{190}_2$ in the first substrate 180 and/or in the second substrate 182, and second recesses forming second channels 192, $\mathbf{192}_1$, $\mathbf{192}_2$ in the first substrate 180 and/or in the second substrate 182. Thus, a fluid volume of the micromechanical sound transducer 100 is increased, allowing a high sound pressure level to be achieved at a high packing density. The first channels 190, $\mathbf{190}_1$, $\mathbf{190}_2$ and the second channels 192, $\mathbf{192}_1$, $\mathbf{192}_2$ run in opposite directions along the second axis x for fluidic coupling of the space with the surroundings. For example, the first channels 190, $\mathbf{190}_1$, $\mathbf{190}_2$ run out of the space in a first direction 116 along the second axis x, and the second channels 192, $\mathbf{192}_1$, $\mathbf{192}_2$ run out of the space in a second direction 118 along the second axis x. In other words, the channels (the first 190, $\mathbf{190}_1$, $\mathbf{190}_2$ and/or the second 192, $\mathbf{192}_1$, $\mathbf{192}_2$ channels) begin within the space and run along their respective direction of travel 116 or 118 to the surroundings. According to one embodiment, adjacent cavities 150 have channels running in opposite directions along the second axis x.

In the cross-section through the micromechanical sound transducer 100 along the cut edge A-A, it may be seen that per cavity 150, channels are formed in both the first substrate 180 and the second substrate 182. Thus, the first channels 190 of the top view are represented in the section A-A by the channels $\mathbf{190}_1$ in the first substrate 180 and the channel $\mathbf{190}_2$ in the second substrate 182, and the second channels 192 in the top view are represented in the section A-A by the channel $\mathbf{192}_1$ in the first substrate 180 and the channel $\mathbf{192}_2$ in the second substrate 182. Alternatively, it is possible that the first channels 190 are formed only in the first substrate 180 or only in the second substrate 182 and/or that the second channels 192 are formed only in the first substrate 180 or only in the second substrate 182.

According to an embodiment, the micromechanical sound transducer in FIG. 3 may also have features and functionalities of the micromechanical sound transducers in FIG. 1 and FIG. 2. For example, if the micromechanical sound transducer 100 in FIG. 3 has transverse connections between bending transducers as described in FIG. 1, the transverse connections may, according to one embodiment, at least partially cover channel $\mathbf{190}_1$ and/or channel $\mathbf{190}_2$. This is schematically sketched for a tranverse connection 7 between the bending transducers $\mathbf{3}_1$ and $\mathbf{3}_2$. Alternatively, the first channels 190, $\mathbf{190}_1$, $\mathbf{190}_2$ and the second channels 192, $\mathbf{192}_1$, $\mathbf{192}_2$ may be arranged along the first axis y in a manner which is offset from the transverse connections 7. This is shown schematically as an optional feature in FIG. 1 with channels 190 and 192.

Figure 4A:
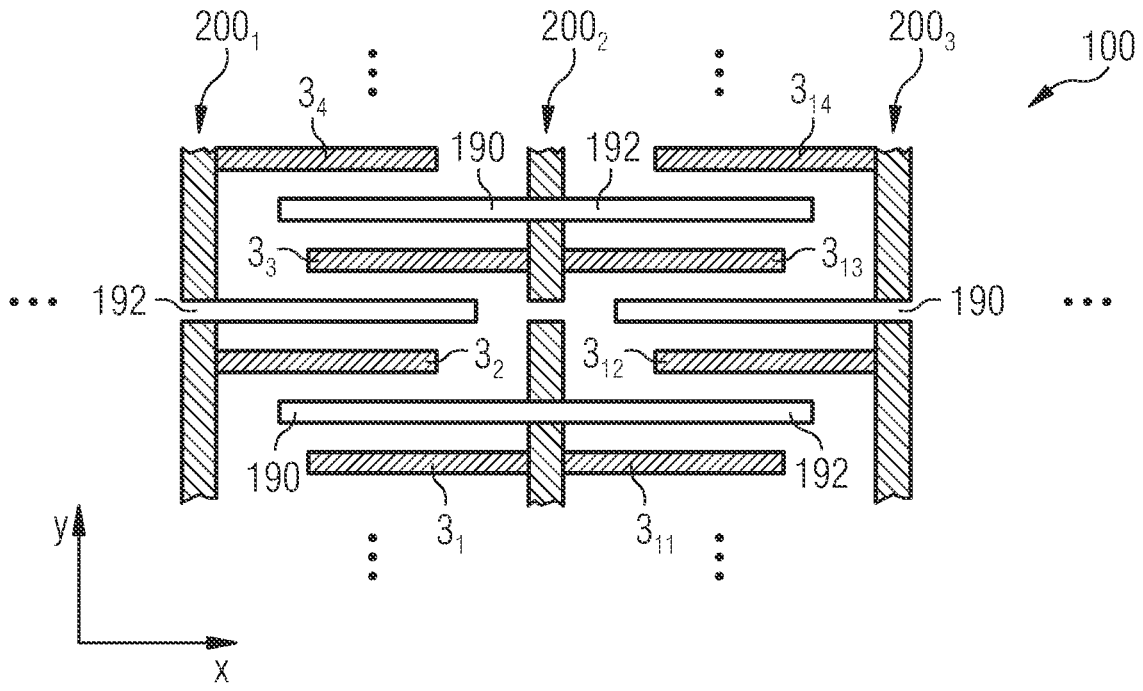
FIG. 4*a* shows a schematic representation of a micromechanical sound transducer comprising an array of bending transducers, according to an embodiment of the present invention.
Figure 4B:
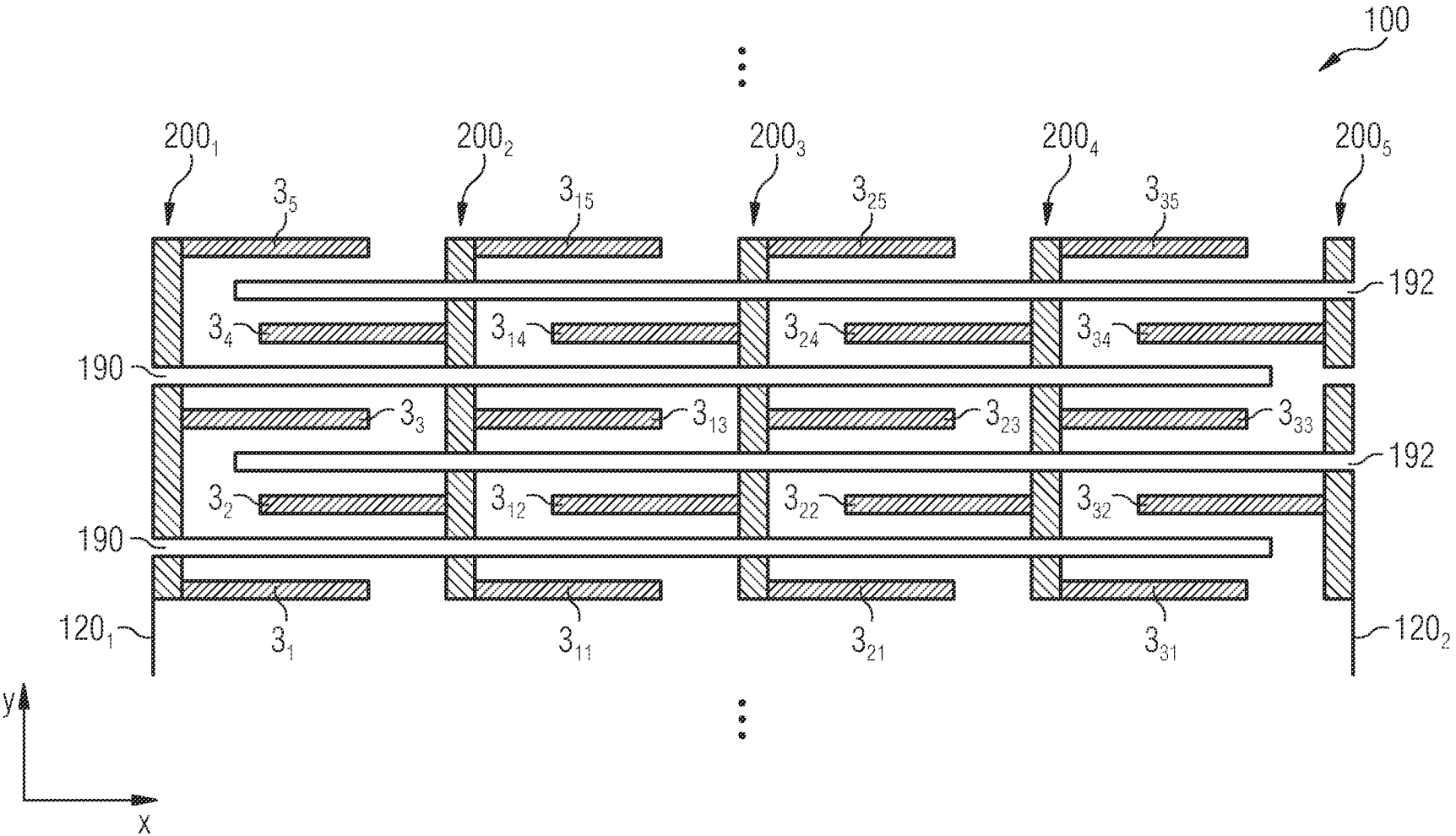
FIG. 4*b* shows a schematic representation of a micromechanical sound transducer comprising an array of bending transducers with connecting channels, according to an embodiment of the present invention.

A bending transducer arrangement, as shown in FIG. 1, FIG. 2 and/or FIG. 3, for example, may be formed by bending transducer modules of a micromechanical sound transducer 100, as shown in FIG. 4*a* or FIG. 4*b*, for example. As shown in FIG. 4*a* or FIG. 4*b*, the bending transducer modules 3 arranged side by side along the second axis x may be connected to one another via the first channels 190 and second channels 192. In FIG. 4*a* and FIG. 4*b*, different variants for implementing an array of bending transducers in a micromechanical sound transducer 100 are shown.

In FIG. 4*a*, for example, first channels 190 converge with second channels 192 in partition walls $\mathbf{200}_1$ to $\mathbf{200}_3$ between the individual bending transducer modules, where they may be connected via an opening that runs transversely through a first and/or second substrate that marks off a space in which the bending transducers 3 are arranged in parallel with the plane of vibration (x,y) on opposite sides. Thus, the cavities may fluidically couple the cavities to the surroundings via the first 190 and/or second 192 channels and the associated openings. Alternatively, the openings may be arranged transversely through the first and/or second substrate at any point of the first 190 and/or second 192 channels. Optionally, the channels 190, 192 may also have the opening transversely through the first and/or second substrate along their entire length. In other words, the opening extends transversely through the first and/or second substrate in a manner that is perpendicular to the plane of vibration (x,y).

In FIG. 4*b*, however, the first channels 190 and the second channels 192 run through all bending transducer modules arranged along the second axis x and open laterally into the surroundings. For example, the first channels 190 open on a first side 1201 of the micromechanical sound transducer 100, and the second channels 192 open on an opposite side of a second side $\mathbf{120}_2$. Thus, for example, the first channels 190 penetrate all partition walls $\mathbf{200}_1$ to $\mathbf{200}_4$ except an outer wall $\mathbf{200}_5$, and the second channels 192 penetrate all partition walls $\mathbf{200}_2$ to $\mathbf{200}_5$ except an outer wall $\mathbf{200}_1$.

Thus, very effective sound transducers may be implemented by a modular design of the micromechanical sound transducers 100. Especially by coupling the single modules with the first channels 190 and/or the second channels 192, high sound levels may be generated since many bending transducers 3 can interact within a small space and may thus exert a high force on a fluid within the micromechanical sound transducer.

Even if in FIG. 4*a* and FIG. 4*b* the bending transducers 3 are suspended on one side only, suspension of the bending transducers 3 on both sides is also possible.

Further embodiments of the micromechanical sound transducer described herein will be described in other words below.

The micromechanical sound transducers described herein are, for example, an arrangement of actuator elements, which may be referred to as bending transducers, with multiple potentials in MEMS. The invention describes a significant further development of transducers. A major application is the use within closed volumes, e.g. in in-ear earphones. The basic principle of volume use with air chambers is significantly expanded here in the present invention.

Figure 6A:
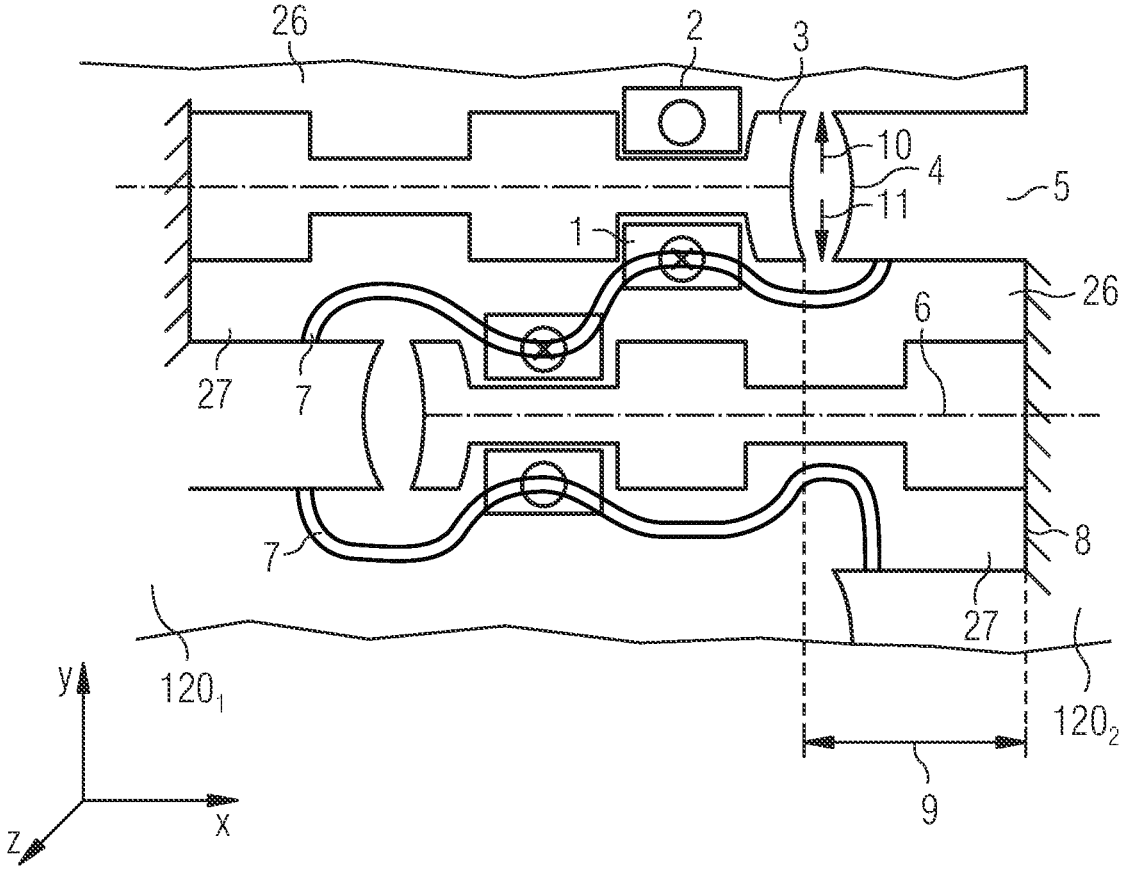
FIG. 6*a* shows a schematic representation of a micromechanical sound transducer comprising transverse connections which follow contours of adjacent bending transducers, according to an embodiment of the present invention.

The embodiment shown in FIG. 6*a* shows:

- first and second vertical flow directions 1 and 2 (e.g. at a first point in time; flow directions 1 and 2 may be reversed at a second point in time; at the first point in time, bending transducers undergo e.g. a first deflection, and at the second point in time, bending transducers undergo e.g. a second deflection which is opposite to the first deflection).
- two bending transducers 3, clamped on one side and operating in push-pull mode, offset by 9 in such a way that the respective opposite shapes of the respective transducer engage with each other
  - advantage of push-pull: compensation of inertial forces
  - the shape of the actuators is shown in a simplified form in the figures, the shape and arrangement achieve the inventive object of "increasing the packing density"
- when the first transducer is moved in the direction 10, the volume flow from the cavity is transported along by 2 and into the cavity by 1
  - in the same time interval, the second bending transducer is moved away from the first bending transducer and, thus, a volume flow is transported into the cavity
- potential tranverse connection 7 is arranged as a partition between the two cavities, the potential transverse connection 7 is, e.g., the edge of the cavity (description will follow below)
- bending transducers 3 have a centroid fiber 6
- the contour of the closure of the cavity 4 follows the contour of movement of the bending transducer 3, with a gap as narrow as possible
- first sub-cavity 26 formed by the first side of the bending transducer 3 and by the adjacent potential transverse connection 7, as well as substrate in the area of the clamping and the freely movable end of the bending transducer 3
- second sub-cavity 27 formed by the side opposite the first side of the bending transducer 3 and by the potential transverse connection 7 adjacent to this side, as well as substrate in the area of the clamping and the freely movable end of the bending transducer 3
- the potential transverse connection simultaneously represents, for example, a boundary of sub-cavities 26 and 27.

FIG. 6*a* shows an example of a side wall (potential transverse connection 7) that follows the contour of the bending transducers. According to one embodiment, the transverse connection 7, which electrically connects the bending transducers to one another, is elevated. This means, for example, that the transverse connection 7 has an extension along a third axis z, perpendicular to a plane of vibration (x,y), and does not represent a conductor path as depicted on a circuit board. The fact that the transverse connection 7 follows the contour of the bending transducers 3 prevents them from touching the transverse connections.

According to an embodiment, the directions of movement 10 and 11 directions correspond to a deflection 110 of bending transducers as shown in FIG. 1 and FIG. 2.

Figure 6B:
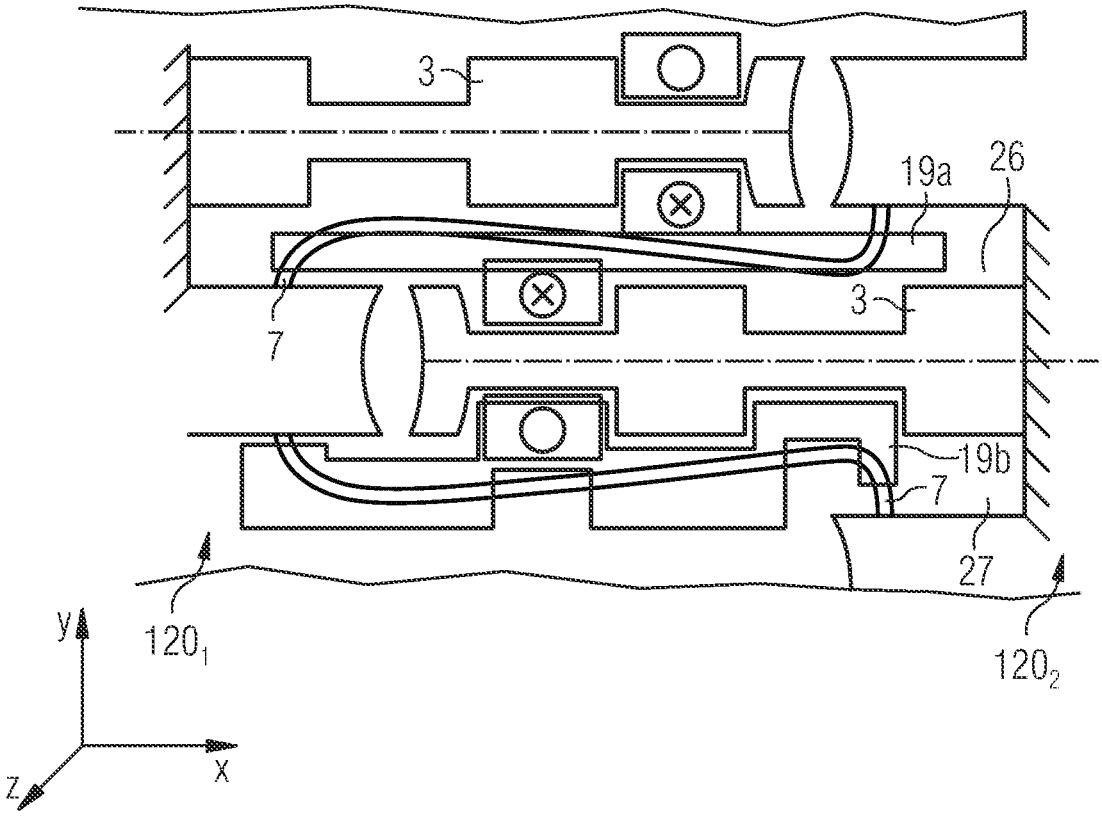
FIG. 6*b* shows a schematic representation of a micromechanical sound transducer having openings in a first substrate and in a second substrate, according to an embodiment of the present invention.

In the embodiment according to FIG. 6*b*, two alternative designs of a cover opening (abstract representation) are additionally shown by 19*a* and 19*b*:

- 19*a* cover opening does not follow the contour of the side wall (potential tranverse connection)
- 19*b* base opening follows the side wall (potential transverse connection). According to one embodiment, the opening 19*b* follows a shape of the actuator (e.g. of the bending transducer)
- The openings in both the cover and the base may follow the side wall (potential transverse connection) or have an alternative contour Optional Comments on FIG. 6*b*:

The cover defines, e.g., a boundary of the sub-cavities 26, 27 above the bending transducers 3, and the base defines, e.g., a boundary of the sub-cavities 26, 27 below the bending transducers 3. In other words, the cover defines, e.g., a boundary parallel to a plane of vibration (x,y) in a first direction along a third axis z, perpendicular to the plane of vibration (x,y), and the base defines, e.g., a boundary parallel to the plane of vibration (x,y) in a second direction, opposite to the first direction, along the third axis z. According to an embodiment, the base may be referred to as the first substrate, and the cover may be referred to as the second substrate.

Although 19*a* is referred to as a cover opening and 19*b* is referred to as a base opening, it is clear that according to one embodiment, 19*a* may also represent a base opening and 19*b* may also represent a cover opening.

In other words, in FIG. 6*b*, for example, a contour of the at least one opening (e.g. the base opening 19*b*) in a first substrate and/or in a second substrate of the first sub-cavity 26 and/or the second sub-cavity 27 at least partially follows a shape of a bending transducer side facing the respective opening.

According to an embodiment, the one or more openings (e.g. the cover opening 19*a* and/or the base opening 19*b*) via which, for each bending transducer 3, the cavities 26, 27 adjacent to the bending transducer sides of the respective bending transducer 3 which face away from one another along a first axis y are fluidically coupled to the surroundings are arranged on sides, facing away from each other, of a space in which the bending transducers are arranged.

According to an embodiment, the one or more openings via which the cavities are fluidically coupled to the surroundings run transversely through the first and/or second substrate.

For example, the first sub-cavity 26 and the second sub-cavity 27 each have at least one opening 19*a*, 19*b* in the first substrate or in the second substrate. Adjacent subcavities 26, 27 which are only separated from one another by a transverse connection 7 may share one opening. In contrast, sub-cavities 26, 27 which are separated from one another by a bending transducer each have a separate opening, for example.

According to an embodiment, the at least one opening 19*a*, 19*b* of the first sub-cavity 26 and/or the second sub-cavity 27 extends along an entire extension, along the second axis, of a bending transducer adjacent to the opening, or extends at least partially along the extension, along the second axis, of the adjacent bending transducer.

According to an embodiment, the bending transducers 3 and/or the transverse connections 7 are arranged in such a way that the bending transducers 3 do not sweep the openings 19*a*, 19*b*.

Features and functionalities as described in connection with FIG. 6*a* and FIG. 6*b* may be included in embodiments of FIGS. 1 to 5.

Figure 7:
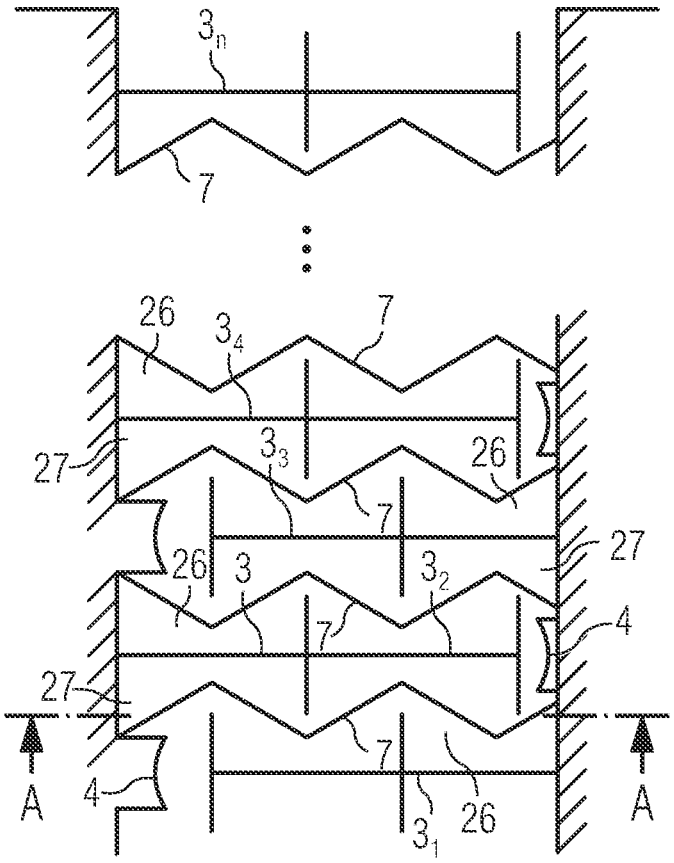
FIG. 7 shows an abstract representation of a section of a micromechanical sound transducer comprising a multitude of bending transducers, according to an embodiment of the present invention.

The embodiment according to FIG. 7 shows an abstract representation of a section of a bending transducer system (e.g. of a micromechanical sound transducer) with a multitude of bending transducers $\mathbf{3}_1$ to $\mathbf{3}_n$. What is shown is opposite clamping of adjacent bending transducers, an offset of the bending transducers and a potential transverse connection 7 which follows the contour of the transducers.

The embodiment according to FIG. 8 shows, in a sectional view (see FIG. 7), method steps of producing a potential transverse connection 7 with an indentation from a silicon piece. An unmachined silicon piece is shown first (hatched). Below it (centre), a dashed area (indentation) to be worked out is also shown. The bottommost schematic illustration shows a potential transverse connection 7 which is machined in such a way that an electrical path 210, located within the silicon, is not damaged and is located below the indentation. In other words, FIG. 8 shows an etching technique to reduce or adjust a height (extension along a third axis z). The resulting indentation serves to couple (connect) different cavities to one another. In other words, e.g. two sub-cavities are fluidically connected to each other via the lowered tranverse connection 7. Below the transverse connection 7, for example, a continuous spacer layer 23 is arranged which electrically insulates the transverse connection 7 from a substrate (e.g. from a cover or a base).

Figure 9:
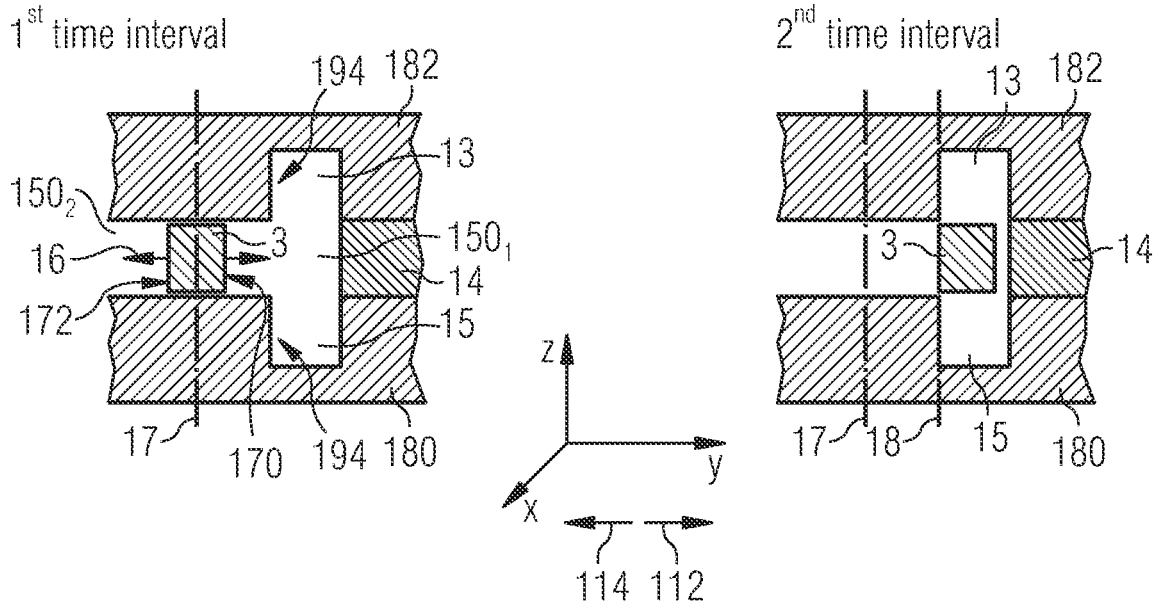
FIG. 9 shows a schematic cross section of a micromechanical sound transducer at two points in time, according to an embodiment of the present invention.

FIG. 9 shows an embodiment for increasing a volume of a cavity. A cross-section of a bending transducer 3 is shown in each case.

$1^{st}$ time interval: bending transducer 3 is not deflected.

$2^{nd}$ time interval: bending transducer 3 is deflected.

Above and below the device wafer 14 there are clearances 13 and 15 in the cover and handling wafer. According to an embodiment, the handling wafer may be referred to as the first substrate 180, and the cover wafer may be referred to as the second substrate 182. For example, clearances 13 and 15 are clearances that may form first and/or second channels, as shown and described in FIG. 1 or FIG. 3 to FIG. 4*b*, for example.

In the maximally deflected state ($2^{nd}$ time interval), the bending transducer is located e.g. in the area of clearances 13 and 15. According to an embodiment, bending transducer 3 is not necessarily located at this point. However, the bending transducer must not be deflected further than shown, for example.

That side of the clearance which is opposite to the side wall (potential transverse connection) of the cavity follows the contour of that side of the bending transducer, deflected to the maximum, that faces away from the side wall (potential transverse connection). (FIG. 4) They thus form a line 18.

According to an embodiment, the potential transverse connection is located at the location of the device wafer 14. According to the section of a micromechanical sound transducer that shown in FIG. 9, a cavity e.g. between the bending transducer 3 and the transverse connection (the potential transverse connection in the device wafer 14) is completely closed off laterally (on opposite sides along a first axis y). Via openings in the transverse connection and/or in the first substrate 180 and/or in the second substrate 182 that are not drawn, the cavity may be coupled to the surroundings and/or coupled to adjacent cavities.

According to an embodiment, a side 194, facing a first direction 112 along the first axis y, of the cavity 1501 adjacent to the bending transducer 3 in the first direction follows a contour of a side 172, facing the second direction 114, of the bending transducer 3 at maximum deflection (see e.g. line 18). This also applies, in a mirrored manner, e.g. to cavities 1502 which are adjacent to the bending transducer 3 in the second direction 114: a side, facing the second direction 114 along the first axis y, of the cavity 1502 adjacent to the bending transducer 3 in the second direction follows a contour of a side 170, facing the first direction 112, of the bending transducer 3 at maximum deflection.

The advantage of this configuration is that a larger volume is available and, thus, a higher sound pressure may be generated. This is, for example, independent of whether the clearances 13, 15 are arranged in the cover and/or handling wafer and/or on the longitudinal side.

By increasing the volume, it is advantageously possible to obtain a high packing density of the bending transducers without having to accept restrictions in terms of volume. In an embodiment, a higher volume may be achieved with the packing density unchanged.

Even if only one channel (formed e.g. by the clearances 13 and/or 15) per cavity 150 is shown in FIG. 1 and FIG. 3 to FIG. 4*b*, one channel may also be formed per sub-cavity 26, 27. According to an embodiment, the channels of adjacent sub-cavities (e.g. separated by the transverse connection 7) either run along the second axis x in opposite directions or in the same direction.

Figure 10A:
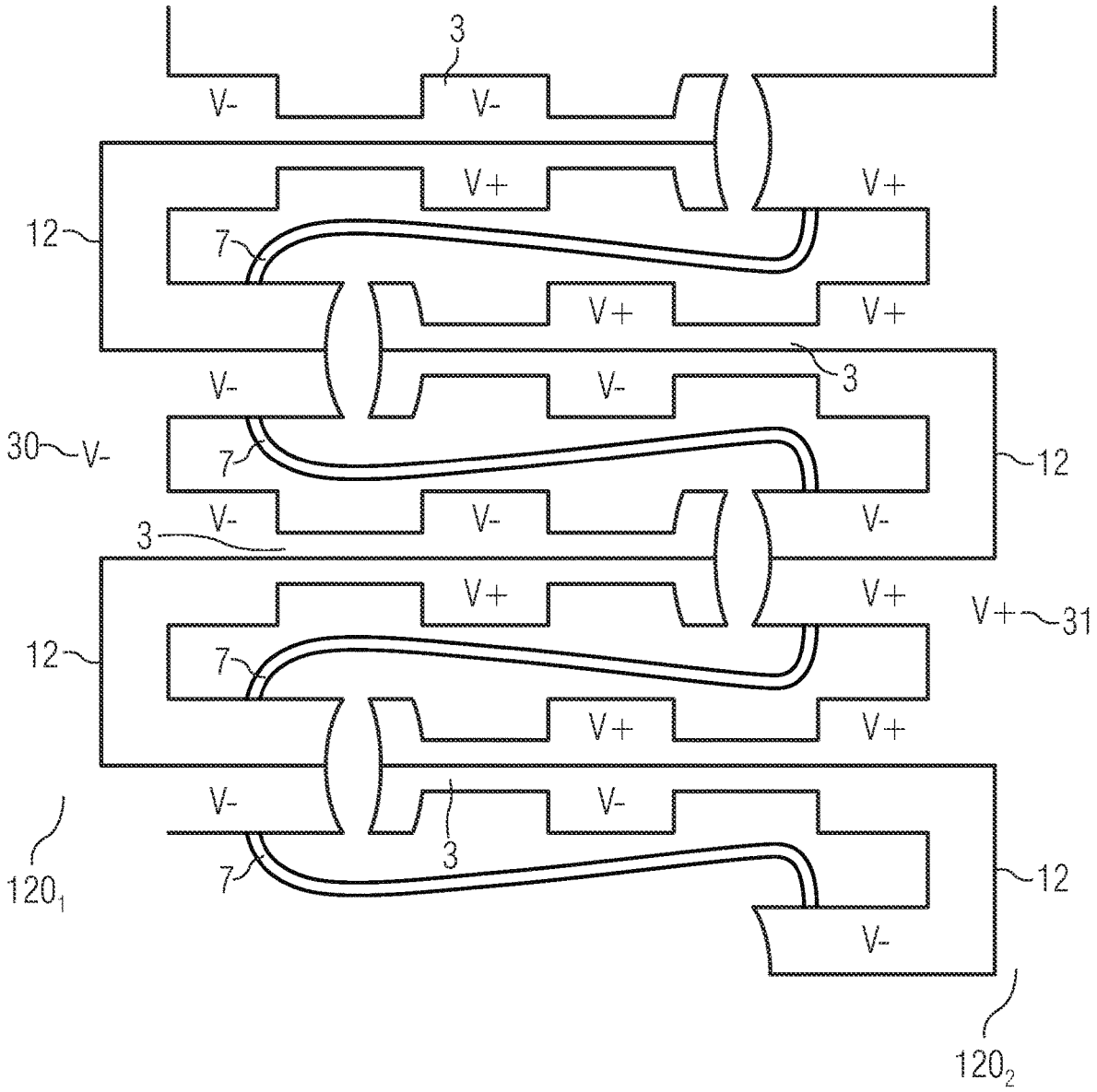
FIG. 10*a* shows a schematic representation of a first interconnection of the plurality of bending transducers of a micromechanical sound transducer, according to an embodiment of the present invention.
Figure 10B:
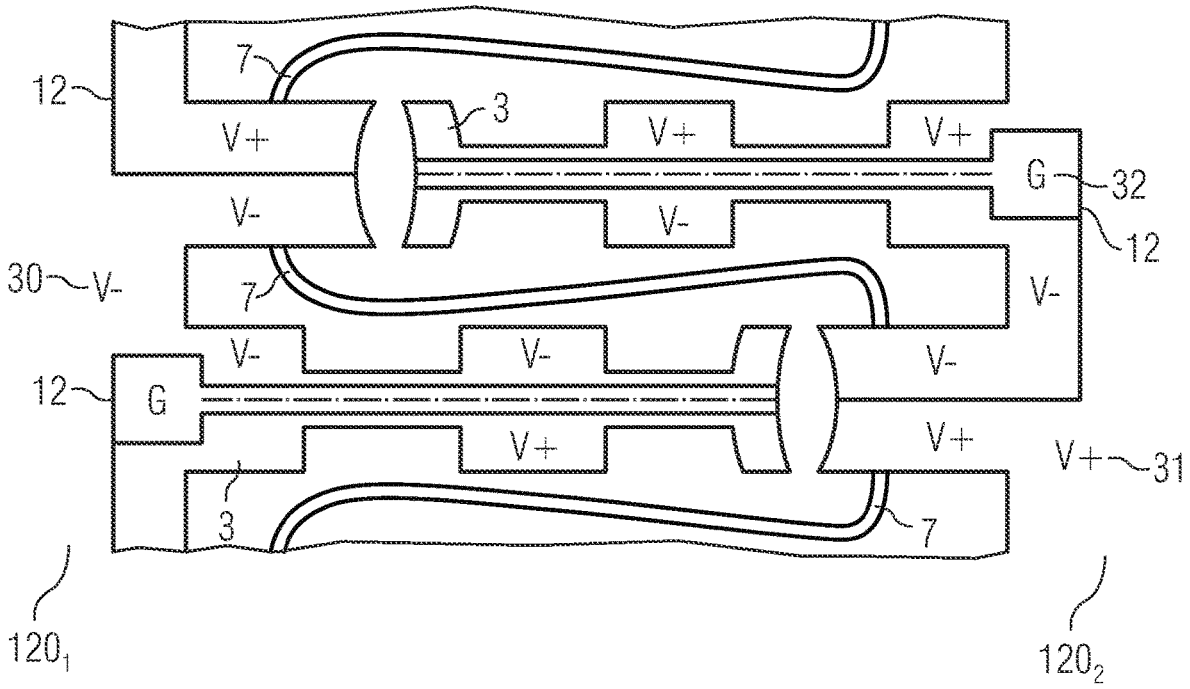
FIG. 10*b* shows a schematic representation of an alternative interconnection of a plurality of bending transducers of a micromechanical sound transducer, according to an embodiment of the present invention.

FIGS. 10*a* and 10*b* may be considered together. FIG. 10*a* shows an embodiment of an interconnection of alternately arranged bending transducers 3. For reasons of clarity, openings in the cover and handling wafer 1 and 2, as well as a third potential 32 are not shown. Identification of the sub-cavities has been omitted.

On the device-wafer level, a potential transverse connection 7 is routed next to the bending transducer 3 as a side wall of the first cavity 26 or the second cavity 27. The oppositely located substrate sides 1201 and $\mathbf{120}_2$ have areas of different potentials which are electrically separated from one another by an insulating layer 12. The electrical connection of the two opposite substrate sides 1201 and $\mathbf{120}_2$ is effected by the potential transverse connection. The bending transducers 3 are arranged in such a way that adjacent electrodes have the same potential.

FIG. 10*b* shows a section of two adjacent bending transducers 3 and further details of the connection. For reasons of clarity, the inlets and outlets 1 and 2 are not shown. Identification of the sub-cavities has been omitted. A third electrical potential 32 is in turn electrically separated by an insulating layer 12.

According to an embodiment, a sound transducer described herein (see FIG. 1 to FIG. 9) has the wiring shown in FIG. 10*a* and/or FIG. 10*b*.

Figure 11A:
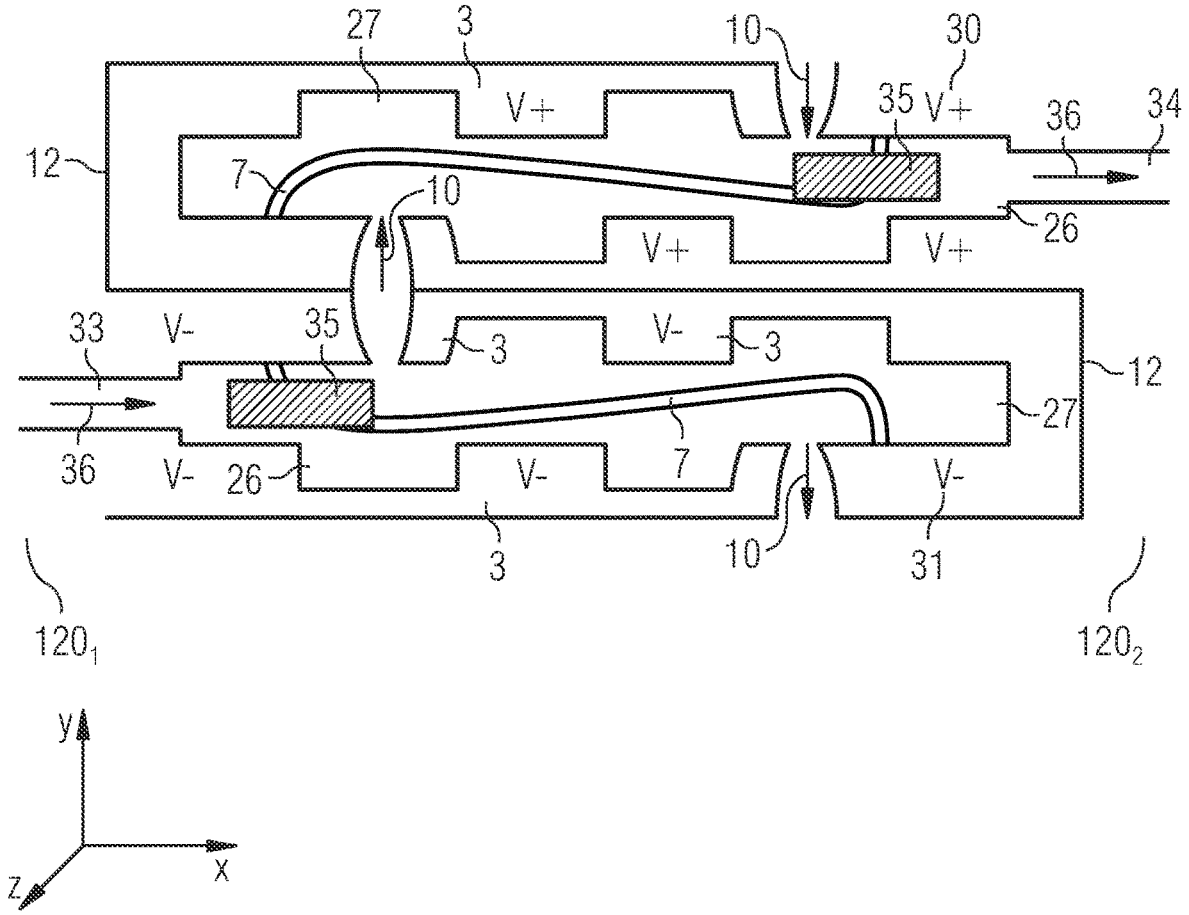
FIG. 11*a* shows a schematic representation of a micromechanical sound transducer comprising lateral openings to the surroundings at a first point in time, according to an embodiment of the present invention.
Figure 11B:
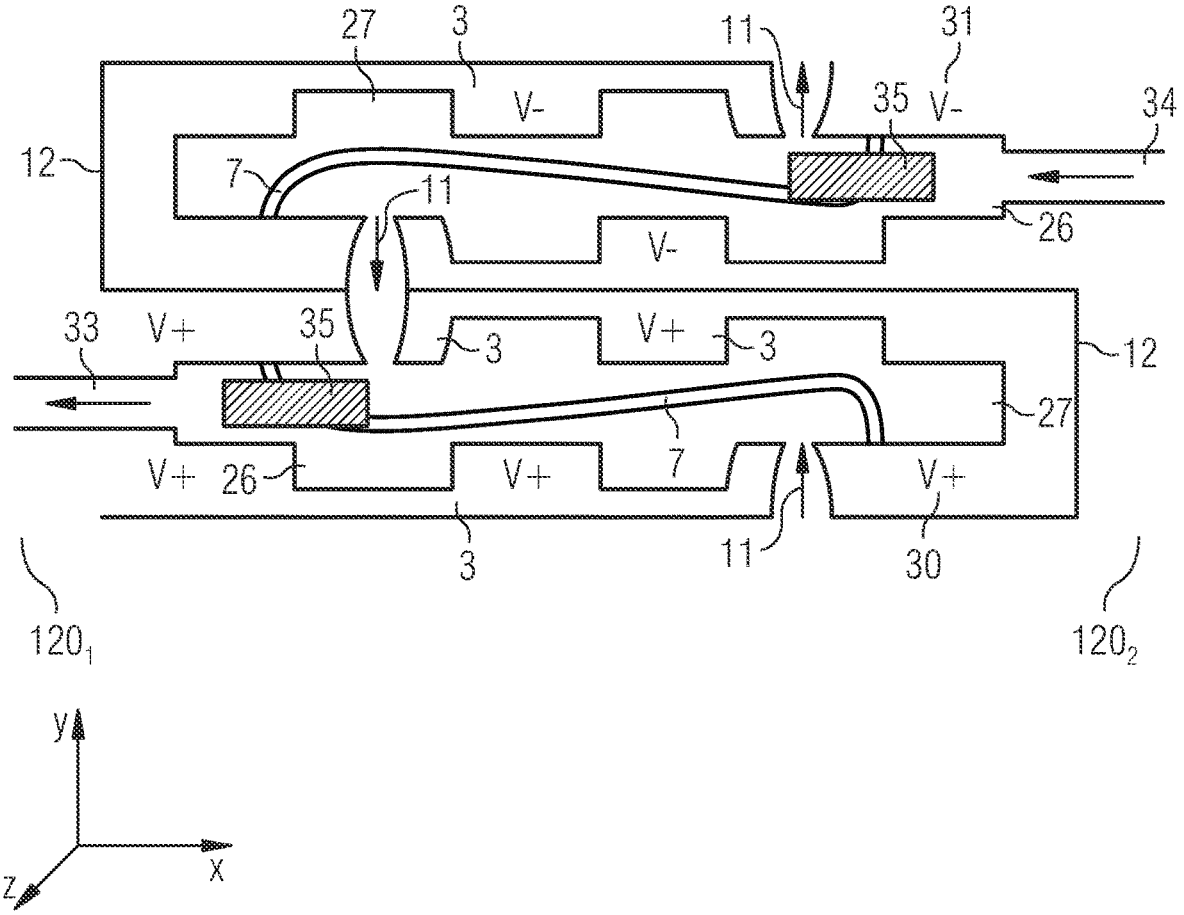
FIG. 11*b* shows a schematic representation of a micromechanical sound transducer comprising lateral openings to the surroundings at a second point in time, according to an embodiment of the present invention.

FIG. 11*a* and FIG. 11*b* show an embodiment and sections of a number of adjacent bending transducers 3:

- laterally arranged openings 33 and 34 for allowing the liquid or gas (e.g. a fluid) to enter and to exit
- bending transducer 3 and potential tranverse connection 7, first and second potentials 30 and 31,
- the openings 33 and 34 perpendicular to the lateral deflection of the bending transducers 3 are arranged alternately. They can, for example, be coupled to first and/or second channels (see e.g. FIG. 1 or FIG. 3 to FIG. 4*b*).

Each potential is assigned an opening, for example.
- 1201 and $\mathbf{120}_2$ are a first and a second substrate side.
- areas 35 of the potential transverse connection 7 are lowered to allow a volume flow across the potential transverse connections; by the liquid or the gas simultaneously flows through adjacent sub-cavities separated by the potential transverse connection 7
- advantage: Coupling of two bending transducers 3 and, thus, doubling of the resulting force acting on the liquid or gas.
- FIG. 11*a* shows a first time interval in which two adjacent bending transducers 3, whose mutually facing electrodes have the same potential 3, move toward each other and thereby generate a volume flow 36 which removes a liquid or a gas from the respective sub-cavities through the second horizontal opening 34. At the same time, a volume flow 36 conveys a liquid or a gas into the adjacent sub-cavities through the first opening 33, which is arranged perpendicular to the lateral deflection
- FIG. 11*b* shows a second time interval which immediately follows the first time interval and in which the bending transducers move in the opposite direction 11 and, thus, a volume flow 36 conveys the fluid into the sub-cavities through the second opening 34, arranged perpendicular to the lateral deflection, and a volume flow 36 conveys the fluid out of the sub-cavities through the first horizontal opening.

Optional Comments on FIG. 11*a* and/or FIG. 11*b:*

According to an embodiment, the one or more openings (e.g. the laterally arranged openings 33 and 34), via which, for each bending transducer 3, the cavities adjacent to the bending transducer sides of the respective bending transducer 3 which face away from one another along the first axis are fluidically coupled to the surroundings, are arranged on sides of the space which face away from each other (e.g. on the first substrate side 1201 and/or on the second substrate side $\mathbf{120}_2$). In other words, the one or more openings of adjacent cavities are located on sides of the space which face away from each other.

According to an embodiment, for each first cavity (e.g. a cavity formed by two sub-cavities 26 and 27 adjacent to a common bending transducer) the micromechanical sound transducer has at least one lateral opening (33, 34) in that side where the bending transducer is suspended within the respective first cavity. In other words, the openings are arranged within a plane of vibration (x,y) in a device substrate (to which the bending transducers 3 are connected) in a clamping region of the bending transducer 3. Alternatively, the openings 33 and/or 34 may be located on one side of the freely vibrating end of the bending transducers 3. Two adjacent sub-cavities 26 and 27, which are arranged separately from each other by the tranverse connection 7, may form a second cavity (also referred to as cavity 150 in the preceding embodiments), each of which also has only one lateral opening, for example.

According to one embodiment, the one or more openings via which the cavities are fluidically coupled to the surroundings run laterally through a first and/or second substrate (the first and/or second substrate runs, e.g., in parallel with a plane of vibration (x,y) in a first direction along a third axis z). In this way, e.g. the first and/or second channels, as described in connection with the figures FIG. 1 or FIG. 3 to FIG. 4*b*, may be implemented.

FIGS. 12*a* to 12*d* show different designs of the bending transducers used herein in the inventive sound transducer.

Figure 12A:
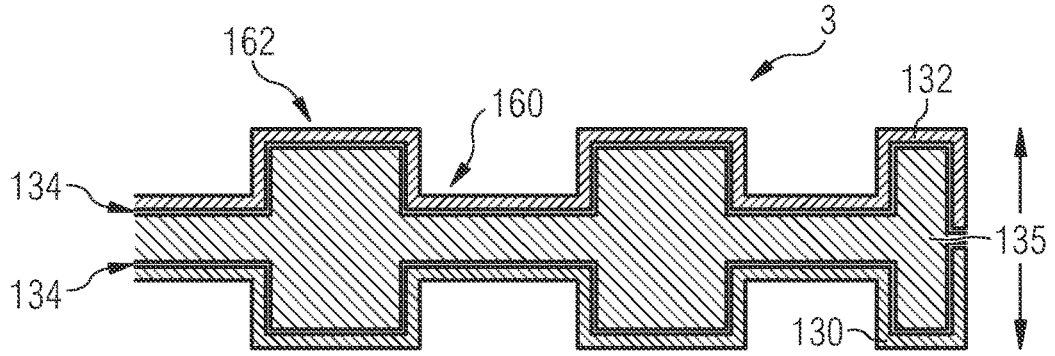
FIG. 12*a* shows a schematic representation of a bending transducer comprising three electrodes, according to an embodiment of the present invention.
Figure 12B:
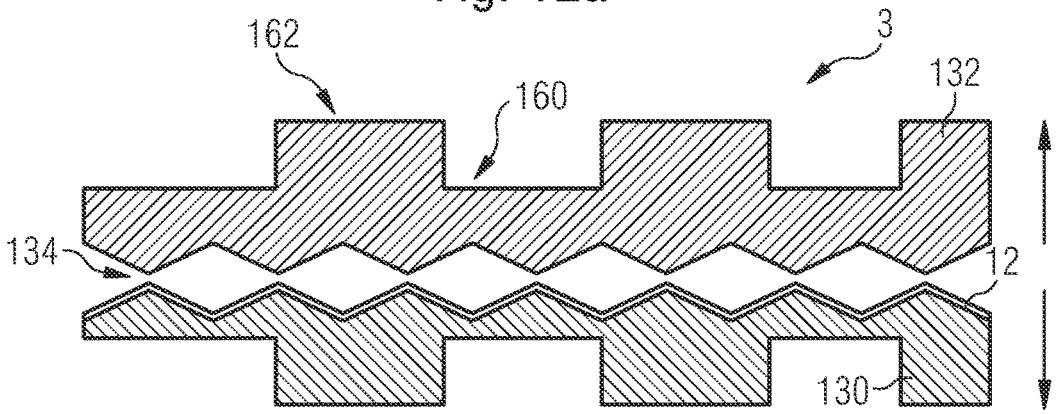
FIG. 12*b* shows a schematic representation of a bending transducer comprising an alternatively shaped slit, according to an embodiment of the present invention.

FIG. 12*a* and FIG. 12*b* both show the same symmetrical contour with different structures. For example, the bending transducer 3 in FIG. 12*a* has three electrodes, a first electrode 130, a second electrode 132 and a central electrode 135, and the bending transducer 3 in FIG. 12*b* has, for example, a first electrode 130, a second electrode 132 and an electrically insulating layer 12. A gap 134 is formed between each of the electrodes.

According to the embodiment in FIG. 12*a* the central electrode 135 is arranged between the first electrode 130 and the second electrode 132. A first gap 134 is arranged between the first electrode 130 and the central electrode 135, and a second gap 134 is arranged between the second electrode 132 and the central electrode 135.

Figure 12C:
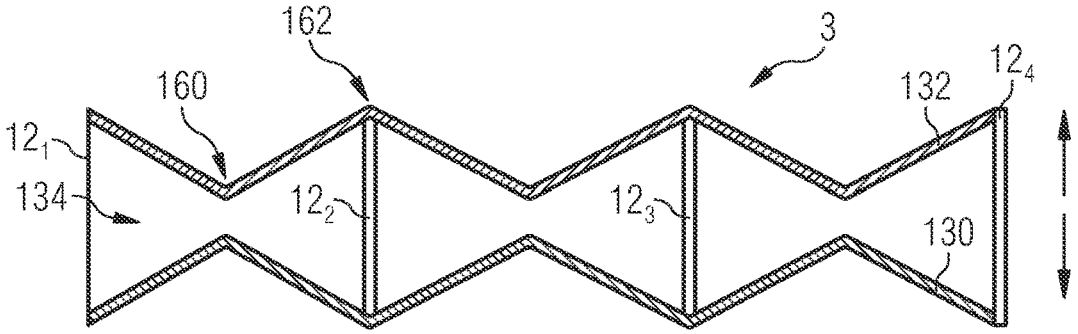
FIG. 12*c* shows a schematic representation of a bending transducer comprising two thin electrodes, according to an embodiment of the present invention.

FIG. 12*c* shows an alternative in which a first electrode 130 and a second electrode 132 are connected to one another at discrete areas in an insulated manner (see 121 to 124). Thus, for example, a gap 134 between the two electrodes 130, 132 is interrupted at several places.

Figure 12D:
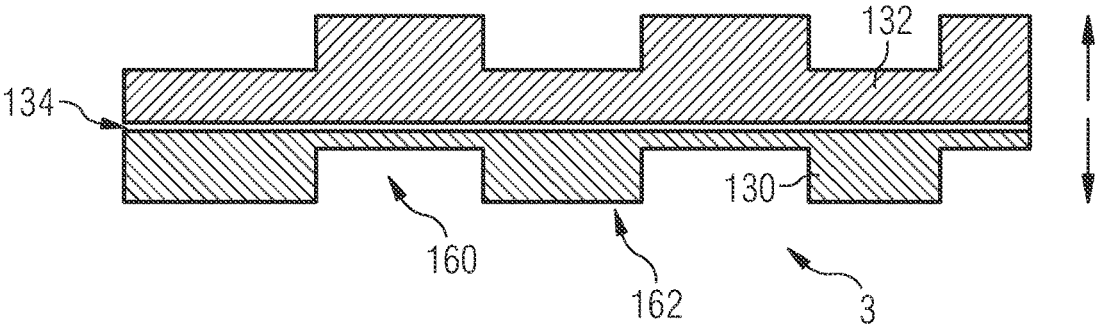
FIG. 12*d* shows a schematic representation of a bending transducer comprising an asymmetrical contour, according to an embodiment of the present invention.

FIG. 12*d* shows a bending transducer comprising an asymmetrical contour. The bending transducer has a first electrode 130, a second electrode 132 and a gap 134 between them.

The fact that the bending transducers 3 of FIGS. 12*a* to 12*d* have projections 162 and depressions 160 allows a high packing density to be achieved.

The bending transducers 3 shown in FIGS. 12*a* to 12*d* may be used in the micromechanical sound transducers 100 described above.

In the following FIGS. 13*a* to 14*b*, different possibilities of wiring the bending transducers within the sound transducer are shown.

Figure 13A:
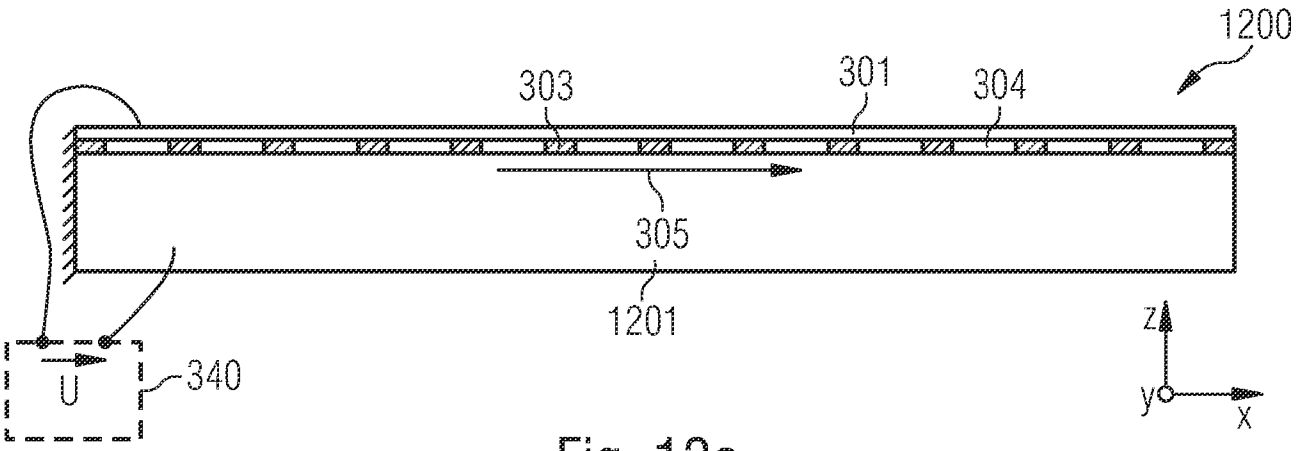
FIG. 13*a* shows a schematic top view of a bending transducer comprising two electrodes, according to an embodiment of the present invention.
Figure 13B:
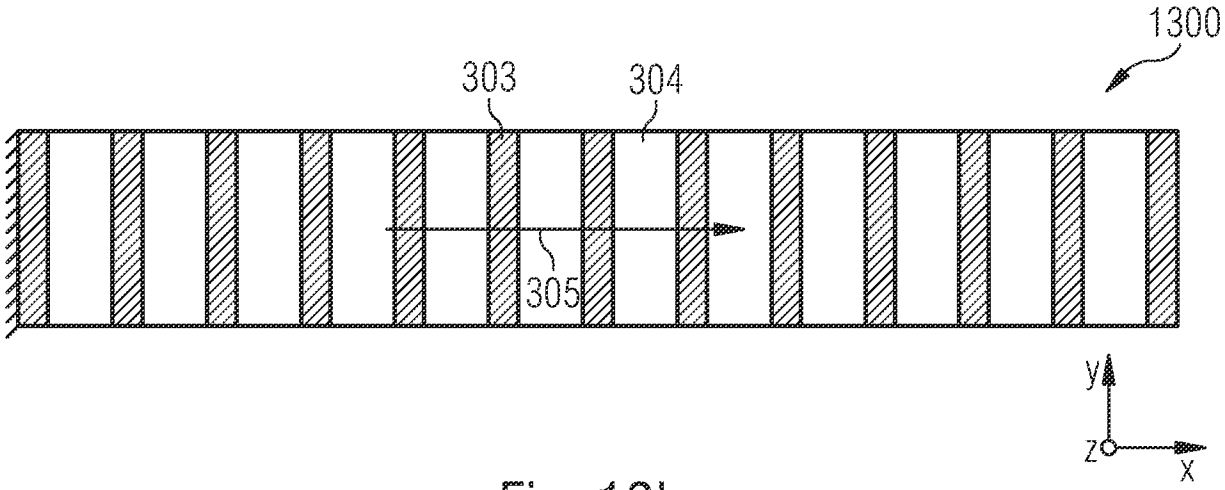
FIG. 13*b* shows a schematic cross section of a bending transducer according to the embodiment of FIG. 13*a;*

FIGS. 13*a*, 13*b* show a beam clamped on one side as an example of a deformable element (plan view 1200 and cross-section 1300). Here, an insulating material 303 (e.g. the insulating layer 12 of the previous description) and an electrically conductive material 301 (e.g. the second electrode 132 of the previous description) are applied above an electrically conductive beam 1201 (e.g. the first electrode 130 of the previous description). The insulating material 303 can, for example, be laterally structured, by using sacrificial-layer technology, such that a thin void 304 is formed between the electrodes 1201 and 301. The void has the thickness of the dielectric sacrificial layer and thus defines the plate spacing of the capacitor. If an electrical voltage is applied between the electrodes 1201 and 301, the vertical forces of the electrostatic field result in a lateral expansion on the surface of the beam. As a result of the surface strain, the beam is deflected (by analogy with the bi- or monomorph principle described above). If, as shown in 13*a*, 13*b*, regular lateral geometries are used, the surface strain will be approximately constant, and a spherical deformation profile w(x) will be established.

In other words, FIGS. 13*a* and 13*b* show a micromechanical component comprising an electrode 301 and a deformable element 1201, which in the present case is designed as a beam or plate clamped on one side, but might be designed differently, as it is also the subject of the figures described below, and comprising an insulating spacer layer 303, wherein the electrode 301 is fixed to the deformable element 1201 via the insulating spacer layer 303, and wherein the insulating spacer layer 303 is structured, along a lateral direction 305 coinciding with the x-direction in FIGS. 13*a* and 13*b*, into several spaced-apart segments hatched in FIGS. 13*a* and 3*b*, so that by applying an electric voltage between the electrode 301 and the deformable element 1201, lateral tensile or compressive forces are generated which bend the deformable element along the lateral direction 305, here in the positive or negative z direction. As shown in FIG. 13*b*, the segments may each have a direction of longitudinal extension which is transverse to the lateral direction 305. In the embodiment of FIGS. 13*a* and 13*b*, the segments have a strip-shaped design. The same applies, of course, to the interstices 304 between them.

The deformable element 1201 need not necessarily be a plate or a beam. It may also be designed as a shell, membrane or bar. In particular, the deformable element 1201 may be suspended and clamped, as in the case of FIGS. 13*a* and 13*b*, in such a way that it remains unbent by application of the electrical voltage U along a lateral direction perpendicular to the lateral direction 305, in this case the y direction. However, the following embodiments will also show that the deformable element may be suspended and clamped in such a way that, when the electric voltage U is applied between the electrode and the deformable element along a lateral direction perpendicular to the lateral direction 305, it will bend in the same direction as along the lateral direction 305. The result is a bowl-shaped or helmet-shaped curvature in which, for example, the direction 305 corresponds to the radial direction, and the aforementioned common direction of the curvature along the thickness of the insulating layer 303 points from the electrode 301 to the deformable element 1201.

As indicated by the coordinate system in FIGS. 13*a* and 13*b*, the micromechanical component in a substrate, such as a wafer or a chip, may be formed such that the electrode 301 is fixed in a substrate thickness direction, i.e. of the z direction, above or below the deformable element 1201, so that by the curvature of the deformable element 1201, the same is bent out of a substrate plane corresponding, for example, to the rest position of the deformable element 1201, namely in the direction of curvature which in the case of FIGS. 13*a* and 13*b* points in the opposite direction of z. However, alternative embodiments will also be described below, according to which the micromechanical component may also be formed in a substrate, for example, in such a way that the electrode 301 is fixed laterally to the deformable element, so that the curvature of the deformable element causes it to be curved within the present substrate plane.

The degree of the deflection of the beam or plate or of the deformable element 1201 may be actively varied by changing the electrical voltage.

Figure 14A:
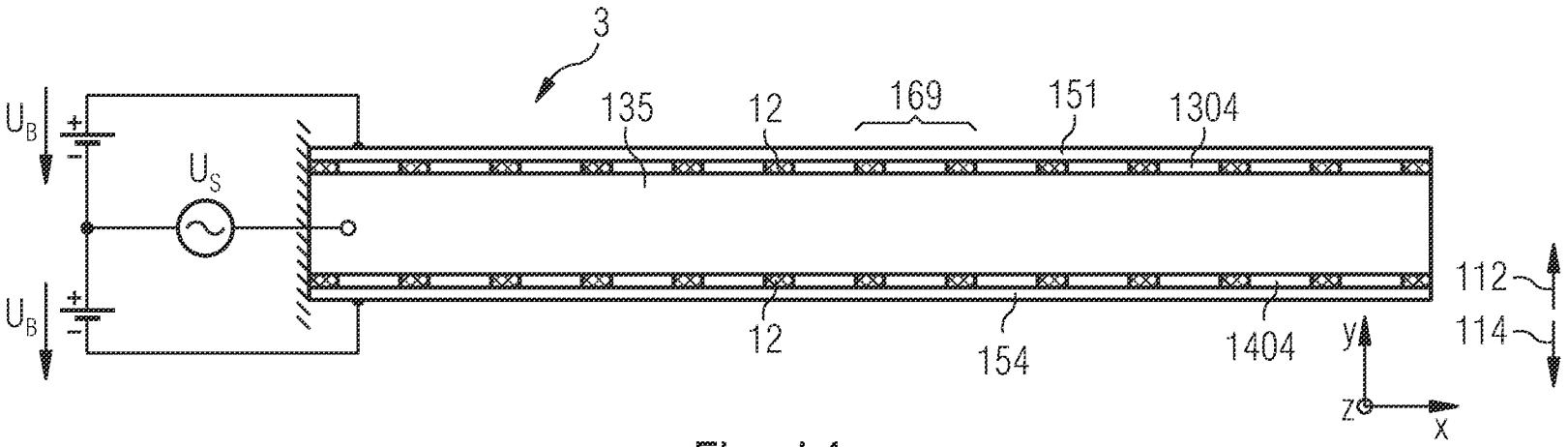
FIG. 14*a* shows a schematic diagram of a circuit a bending transducer comprising three electrodes, according to an embodiment of the present invention.
Figure 14B:
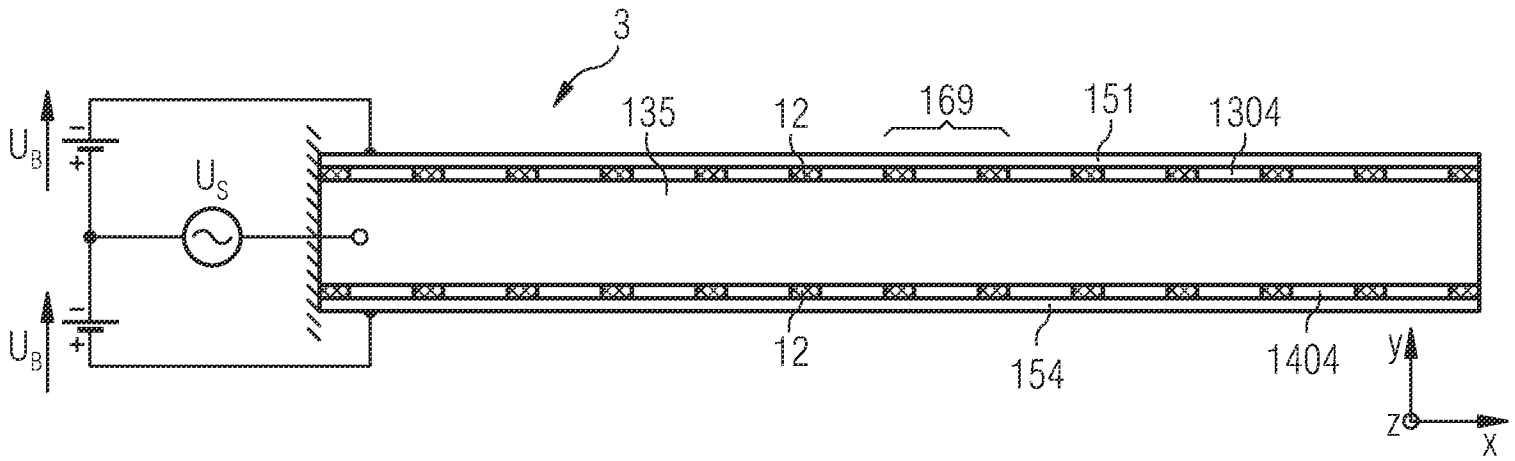
FIG. 14*b* shows a schematic diagram of an alternative circuit of a bending transducer comprising three electrodes, according to an embodiment of the present invention.

The structure of a component based on a bending transducer and operated as an actuator is shown again in FIGS. 14*a* and 14*b* by means of a beam clamped at one end. On both sides of an electrically conductive beam 135, an insulating spacer layer 12 and an electrically conductive material 151 (e.g. the first electrode 130 of the previous description) and 154 (e.g. the second electrode 132 of the previous description) are applied. The insulating spacer layer 12 may be laterally structured, for example by a sacrificial layer technology, such that a thin void 1304 and 1404 (e.g. the gap 134 of the previous description) is formed between the electrodes 135 and 151 and/or between the electrodes 135 and 154 in each of the segments 169 into which the deflectable element is segmented along the longitudinal direction x, leaving insulating spacers 12 at the segment boundaries. The void has the thickness of the dielectric sacrificial layer and thus defines the plate spacing of the capacitor. If an electrical voltage is now applied between electrodes 135 and 151 and/or between electrodes 135 and 154, the forces acting in the y direction of the electrostatic field result in lateral expansion in the x direction on the surface of the beam. As a result of the surface strain, the beam 135 is deflected. If regular lateral geometries are used, the surface strain will be approximately constant, and a spherical deformation profile will be created.

Electrical wiring is made in such a way that an electrical direct voltage $U_B$ is applied to the outer electrodes 151 and 154, and an alternating signal voltage $U_S$, such as an audio signal, is applied to the central electrode, or the bar. An electrical bias voltage is applied to the outer electrodes 151 and 154. The amplitude of the signal AC voltage $U_S$ is equal to or preferably smaller than the electrical bias voltage $U_B$. The highest electrical potential in the system may be selected in an economically sensible manner and may be in accordance with current directives and standards. Due to the electrical bias voltage of the outer electrodes, the curvature of the beam follows the alternating signal voltage $U_S$. A positive half-wave of the alternating signal voltage $U_S$ leads to a curvature of the beam 135 in a negative y direction. A negative half-wave leads to a curvature of the beam 135 in a positive y direction. FIGS. 14*a* and 14*b* show variants of the electrical contact.

FIG. 14*a* shows the respective outer electrodes with an electrical direct voltage applied, but with an opposite electrical potential compared to the representation of FIG. 14*b*.

Alternatively, an electrical bias voltage may be applied to the inner electrode(s). The signal voltage is then applied to the outer electrodes, for example.

Instead of applying an electrical bias voltage to the outer or inner electrode(s), permanent polarization of the outer or inner electrode(s) as an electret, such as silicon dioxide, is possible. Instead of the voltage sources shown in previous figures, current sources may be used.

The topography of the electrodes may be structured. In addition, differently shaped electrodes are conceivable, e.g. dome-shaped. In order to further increase the capacitor surface and, thus, the depositable electrostatic energy, comb-shaped electrodes are conceivable.

The element to be bent, such as the bending transducer 3, may be clamped on one or both sides.

In other words, a micromechanical sound transducer may have a signal port Us, a first reference port $U_B$ and a second reference port $U_B$. The central electrode 135 is coupled to the signal port. The electrode 151 facing a first direction 112 along a first axis y is coupled to the first reference port, and the electrode 154 facing a second direction 114 along the first axis y is coupled to the second reference port. The interconnection of the two outer electrodes of adjacent bending transducers may be performed according to the wiring of the electrodes that is described in FIG. 1.

applying a first voltage between the signal port and the first reference port and a second voltage between the signal port and the second reference port results, for example, in opposite deflections of adjacent bending transducers along the first axis y.

According to an embodiment, the first electrode and the central electrode form a first capacitor, and the second electrode and the central electrode form a second capacitor to form one capacitor on each of bending transducer sides located opposite each other along the first axis y. The capacitors of each bending transducer are deflected in opposite directions along the first axis upon application of voltage, depending on the voltage applied.

In the following, further possible embodiments according to the invention will be described:

Achieving the object according to the invention by, e.g., arranging a bending transducer comprising a cavity.

- Achieving the object according to the invention by
  - arranging the bending transducers by alternating clamping of the bending transducers
  - by offsetting adjacent bending transducers
  - by bordering of the cavity with side walls, which at the same time represent a potential transverse connection
  - by offsetting the cavities from one another
  - arranging the potential transverse connections in the device wafer next to the bending transducer and as a boundary of the respective cavity
- Bending Transducer
- Bending transducer is a microelectromechanical bending transducer (sound and ultrasound) known per se and segmented along its longitudinal direction
  - The topography of the electrodes of the bending transducer may be roof-like or dome-shaped, they may engage with one another like a comb
  - in a first embodiment, the bending transducer is clamped on one side
  - in a further embodiment, the bending transducer is clamped on both sides
- Bending transducers are clamped in an opposite manner and operate in a push-pull mode. They may be of equal length
  - an alternative is a shorter bending transducer which compensates for the offset between two bending transducers
- Cavity
- Large number of cavities
- Each cavity encloses one micromechanical bending transducer
- A cavity consists of the $1^{st}$ and 2nd sub-cavities
  - The $1^{st}$ sub-cavity is limited by a $1^{st}$ side wall (potential tranverse connection) and that side surface of the bending transducer which is opposite the $1^{st}$ side wall (potential tranverse connection).
  - The $2^{nd}$ sub-cavity is limited by a $2^{nd}$ side wall (potential tranverse connection) and that side surface of the bending transducer which is opposite the $2^{nd}$ side wall (potential tranverse connection)
  - The $1^{st}$ and $2^{nd}$ sub-cavities are connected to one another in the area of the base and the cover (above and below the bending transducer)
  - In the case of a bending transducer clamped on one side, the $1^{st}$ and $2^{nd}$ subcavities are connected to one another in the area of the free end of the bending transducer
- In one embodiment, the cavities have vertical openings (inlet and outlet) in the base and/or in the cover
  - Openings in the base and/or in the cover are designed, in one implementation, in such a way that two adjacent sub-cavities are connected to one another by one opening in each case. The sub-cavities are separated from one another in the vertical direction by the side wall (potential transverse connection).
  - Openings extend along the entire length of the bending transducer
  - Openings extend partially along the entire length of the bending transducer
  - In a first implementation, the contour of the openings follows the contour of the cavity
  - In another implementation, the contour of the openings is independent of the contour of the cavity
- In an alternative implementation, the cavities have lateral openings in the area of the clamping of the bending transducer clamped on both sides or in the area of the clamping and of the free end of the bending transducer clamped on one side
  - The openings are arranged perpendicular to the lateral direction of movement Openings may have a rectangular cross-section or a cross-section deviating therefrom
  - The openings extend in the third direction across the entire height of the bending transducer, or are smaller
  - The openings extend in the second direction across the width of the $1^{st}$ or $2^{nd}$ sub-cavity or are smaller and are closed in the clamping area. On the side of the free end of the bending transducer clamped on one side, the openings are separated from one another
  - In this implementation of the cavity, the base and the cover may have clearances for the purpose of increasing the cross-section
  - Arranging the clearances
    - Clearances extend along the first direction
    - Clearances are arranged in the second direction in the area of maximum deflection of the bending beam That side of the clearance which is opposite the side wall (potential transverse connection) of the cavity follows the contour of that side of the maximally deflected bending transducer which faces away from the side wall (potential transverse connection). (FIG. 4)

Clearances have a cross section deviating from a rectangular shape

It is advantageous that the cover and handling wafers

The cavity is formed in such a way that the electrical path in the handling wafer is guided under the cavity.

In an alternative implementation, the cover and handling wafer have clearances arranged across the entire length of the cavity such that they are longitudinal to the bending transducer That side of the clearance which is opposite the side wall (potential transverse connection) of the cavity follows the contour of that side of the maximally deflected bending transducer which faces away from the side wall (potential transverse connection). (FIG. 4) They thus form a line 18

Side Wall (Potential Tranverse Connection)

contour of the side wall (potential transverse connection) follows the contour of the bending transducer in the deflected state Height of the side wall (potential tranverse connection) corresponds to the height of the bending transducer or is smaller Height of the side wall (potential tranverse connection) varies along the first direction of the bending transducer Thickness of the side wall (potential transverse connection) from 1 nm to 1000 μm, advantageously between 500 nm and 200 μm, particularly advantageously between 1 μm and 30 μm Thickness of the side wall (potential tranverse connection) varies along the first direction of the bending transducer Side wall (potential tranverse connection) is connected to the base in the area of the base Or the side wall (potential transverse connection) is partially connected to the base The distance of the non-connected side wall (potential transverse connection) areas varies along the first direction The distance is from 100 nm to 10 mm, advantageously between 1 μm and 1 mm and particularly advantageously between 25 μm and 150 μm Side wall (potential transverse connection) is partially connected to the cover The distance in the third direction of those sub-areas of the side wall (potential transverse connection) that are not connected to the cover varies along the first direction The distance is from 100 nm to 10 mm, advantageously between 1 μm and 1 mm and particularly advantageously between 25 μm and 150 μm The side walls (potential transverse connection) are configured such that they enable complete electrical control of all bending transducers via summarizing individual contacts, for example at the edge of the component The side wall (potential transverse connection) is configured such that the frequency response is favourably influenced by damping (fluidic, mechanical, electrical) (lower quality may be set)

The height of the side wall (potential transverse connection) results from the height of the bending transducers. The choice of the height of the side wall (potential transverse connection) servers to adjust the damping at the same time. (The potential transverse connection cannot be swept since it represents an edge of the cavity, for example)

Arranging the Cavities

Cavities are offset to one another in a first direction by the value of at least a quarter of the segmentation of the bending transducer Cavities are offset to one another in a second direction by the width of the $1^{st}$ or $2^{nd}$ sub-cavity Process for Conveying the Fluid Located within the Cavities In the implementation with openings in the base and cover In a first time interval, a first volume is formed within two adjacent sub-cavities, so that the fluid is conveyed in the direction of these sub-cavities. At the same time, the volume of the sub-cavity opposite the bending transducer is compressed, so that the fluid contained therein is conveyed out of this sub-cavity.

In a second time interval, this volume is reduced so that the fluid contained therein is removed from the adjacent sub-cavities.

In the implementation with openings in the area of the clamping or in the area of the freely vibrating end In a first time interval, a first volume in the first sub-cavity is increased to transport fluid into the first sub-cavity. At the same time, the second volume of the second sub-cavity opposite the bending transducer is reduced, thus removing the fluid from this sub-cavity.

In a second time interval, a second volume in the second sub-cavity is increased, thus conveying fluid into this sub-cavity. At the same time, the first volume of the first sub-cavity opposite the bending transducer is reduced and the fluid contained therein is removed from this sub-cavity.

While this invention has been described in terms of several embodiments, there are alterations, permutations, and equivalents which fall within the scope of this invention. It should also be noted that there are many alternative ways of implementing the methods and compositions of the present invention. It is therefore intended that the following appended claims be interpreted as including all such alterations, permutations and equivalents as fall within the true spirit and scope of the present invention.

The invention claimed is:

1. A micromechanical sound transducer comprising a plurality of unilaterally suspended bending transducers, the plurality of bending transducers being configured for deflection within a plane of vibration and being arranged side by side within the plane of vibration along a first axis, the plurality of bending transducers extending along a second axis transverse to the first axis and being alternately suspended on opposite sides and engaging with one another, wherein each bending transducer comprises a first electrode and a second electrode located opposite one another along the first axis for guiding deflections of the respective bending transducer along the first axis upon application of voltage, and wherein mutually facing electrodes of adjacent bending transducers are electrically connected to one another by a transverse connection which transversely crosses the plane of vibration to the first axis, so that for first bending transducers suspended on a first side of the opposite sides, the electrodes facing a first direction along the first axis are electrically connected to one another and to the electrodes of second bending transducers which face a second direction opposite to the first direction, which second bending transducers are suspended on a second side of the opposite sides, and for the first bending transducers, the electrodes facing the second direction along the first axis are electrically connected to one another and to the electrodes of the second bending transducers which face the first direction.

2. The micromechanical sound transducer as claimed in claim 1, wherein the bending transducers comprise a centroid fiber extending along the second axis; and wherein the bending transducers are formed symmetrically or asymmetrically with respect to the centroid fiber.

3. The micromechanical sound transducer as claimed in claim 1, wherein a gap is arranged between the first electrode and the second electrode of each bending transducer, and the first electrode is connected to the second electrode at discrete regions in an electrically insulated manner.

4. The micromechanical sound transducer as claimed in claim 1, wherein the bending transducers comprise a centroid fiber extending along the second axis; and wherein the bending transducers are formed asymmetrically with respect to the centroid fiber; and wherein a gap is arranged between the first electrode and the second electrode of each bending transducer, and the first electrode is connected to the second electrode at discrete regions in an electrically insulated manner, AND wherein the gap is arranged along the first axis such that it is offset from the centroid fiber.

5. The micromechanical sound transducer as claimed in claim 3, wherein the micromechanical sound transducer comprises a signal port and a reference port, and wherein the electrodes of the first bending transducers which face the first direction along the first axis, and the electrodes of the second bending transducers which face the second direction along the first axis are coupled to the signal port, and wherein the electrodes of the first bending transducers which face the second direction along the first axis, and the electrodes of the second bending transducers which face the first direction along the first axis are coupled to the reference port.

6. The micromechanical sound transducer as claimed in claim 5, wherein application of a voltage between the signal port and the reference port results in opposite deflections of the first bending transducers relative to the second bending transducers along the first axis.

7. The micromechanical sound transducer as claimed in claim 1, wherein a central electrode is disposed between the first electrode and the second electrode;

wherein a first gap is disposed between the first electrode and the central electrode and a second gap is disposed between the second electrode and the central electrode; and wherein the central electrode is fixed to the first electrode and to the second electrode at discrete regions in an electrically insulated manner.

8. The micromechanical sound transducer as claimed in claim 7, the micromechanical sound transducer comprising a signal port, a first reference port and a second reference port, and wherein the center electrode is coupled to the signal port;

wherein the electrodes of the first bending transducers which face the first direction along the first axis, and the electrodes of the second bending transducers which face the second direction along the first axis are coupled to the first reference port, and wherein the electrodes of the first bending transducers which face the second direction along the first axis, and the electrodes of the second bending transducers which face the first direction along the first axis are connected to the second reference port.

9. The micromechanical sound transducer as claimed in claim 7, wherein applying a first voltage between the signal port and the first reference port and a second voltage between the signal port and the second reference port results in opposite deflections of the first bending transducers relative to the second bending transducers along the first axis.

10. The micromechanical sound transducer as claimed in claim 1, wherein the bending transducers overlap within a projection along the first axis by more than 15 percent by area, 35 percent by area, 50 percent by area, 70 percent by area or 85 percent by area between suspension locations of the first and second bending transducers.

11. The micromechanical sound transducer as claimed in claim 1, wherein the bending transducers overlap within a projection along the first axis by a maximum of 50 percent by area, 60 percent by area, 50 percent by area, 70 percent by area or 85 percent by area between suspension locations of the first and second bending transducers.

12. The micromechanical sound transducer as claimed in claim 1, wherein the bending transducers are arranged within a space which is bounded in parallel with the plane of vibration by a first and a second substrate, and divide the space along the first direction into cavities arranged between adjacent bending transducers.

13. The micromechanical sound transducer as claimed in claim 12, wherein each cavity is fluidically coupled to surroundings via one or more openings.

14. The micromechanical sound transducer as claimed in claim 13, wherein the one or more openings, via which for each bending transducer the cavities adjacent to the bending transducer sides of the respective bending transducer which face away from one another along the first axis are fluidically coupled to the surroundings, are arranged on sides of the space which face away from one another.

15. The micromechanical sound transducers as claimed in claim 1, wherein the bending transducers are electrostatic, piezoelectric or thermomechanical bending transducers.

* * * * *